US011987922B2

(12) United States Patent
Huang et al.

(10) Patent No.: US 11,987,922 B2
(45) Date of Patent: May 21, 2024

(54) AUTOMATIC FEEDING DEVICE, CONTROL METHOD THEREOF AND MULTI DRUM WASHING MACHINE

(71) Applicants: CHONGQING HAIER DRUM WASHING MACHINE CO., LTD., Chongqing (CN); HAIER SMART HOME CO., LTD., Shandong (CN)

(72) Inventors: Tao Huang, Shandong (CN); Bingheng Zhou, Shandong (CN); Wenwei Li, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 371 days.

(21) Appl. No.: 17/254,632

(22) PCT Filed: Jun. 12, 2019

(86) PCT No.: PCT/CN2019/090863
§ 371 (c)(1),
(2) Date: Dec. 21, 2020

(87) PCT Pub. No.: WO2019/242546
PCT Pub. Date: Dec. 26, 2019

(65) Prior Publication Data

US 2021/0115613 A1 Apr. 22, 2021

(30) Foreign Application Priority Data

Jun. 21, 2018 (CN) ..... 201810645064.5
Jun. 21, 2018 (CN) ..... 201810645873.6
Jun. 21, 2018 (CN) ..... 201810645876.X

(51) Int. Cl.
*D06F 39/08* (2006.01)
*D06F 39/02* (2006.01)
(Continued)

(52) U.S. Cl.
CPC ..... *D06F 39/02* (2013.01); *D06F 39/022* (2013.01); *D06F 33/37* (2020.02); *D06F 39/028* (2013.01);
(Continued)

(58) Field of Classification Search
None
See application file for complete search history.

(56) References Cited

U.S. PATENT DOCUMENTS 4,981,024 A 1/1991 Beldham

FOREIGN PATENT DOCUMENTS

CN 104178975 A 12/2014
CN 106048985 A 10/2016
(Continued)

OTHER PUBLICATIONS

CN 104178975A, Washing Machine Automatically Feeding Additive And Its Method translation, Shu, 2014 (Year: 2014).*
(Continued)

*Primary Examiner* — Cristi J Tate-Sims
(74) *Attorney, Agent, or Firm* — BUCHANAN INGERSOLL & ROONEY PC

(57) ABSTRACT

An automatic feeding device includes a water supply pipeline with at least two outlets and capable of controllably delivering a water flow to one of the water outlets; liquid storage parts containing additives used when clothes are treated; and a pumping structure for pumping out the additives in the liquid storage parts to the water supply pipeline. A multi-drum washing machine includes at least two water tubs; and is provided with the automatic feeding device,
(Continued)

wherein each of the water outlets of the automatic feeding device communicates with the water tubs in a one-to-one correspondence way. The additives in the liquid storage parts are pumped out by virtue of a negative pressure generated when the water flow passes through the pumping structure, and are flushed into the corresponding water tubs with an inlet water flow of the washing machine.

20 Claims, 11 Drawing Sheets

(51) Int. Cl.

| | |
|---|---|
| *D06F 33/37* | (2020.01) |
| *D06F 105/02* | (2020.01) |
| *D06F 105/42* | (2020.01) |

(52) U.S. Cl.
CPC ..... *D06F 39/088* (2013.01); *D06F 2105/02* (2020.02); *D06F 2105/42* (2020.02)

(56) References Cited

FOREIGN PATENT DOCUMENTS

| | | | |
|---|---|---|---|
| CN | 106283484 | A | 1/2017 |
| CN | 106436185 | A | 2/2017 |
| CN | 206189100 | U | 5/2017 |
| CN | 107287839 | A | 10/2017 |
| CN | 107841852 | A | 3/2018 |
| CN | 109518425 | A | 3/2019 |
| JP | 2011050452 | A | 3/2011 |

OTHER PUBLICATIONS

CN 107841852 A translation, Liquid Preparation Supplying Device (Year: 2018).*
KR 20000014467 U translation, Washing Machine Shower (Year: 2000).*
Office Action dated Apr. 28, 2021, in corresponding Chinese Patent Application No. 201810645876.X and English translation of the Office Action. (16 pages).
International Search Report (PCT/ISA/210), with translation, and Written Opinion (PCT/ISA/237) dated Aug. 29, 2019, by the Chinese Patent Office as the International Searching Authority for International Application No. PCT/CN2019/090863.

* cited by examiner

AUTOMATIC FEEDING DEVICE, CONTROL METHOD THEREOF AND MULTI DRUM WASHING MACHINE

TECHNICAL FIELD

The present disclosure relates to a drum washing machine in the field of household appliances, particularly to a multi-drum washing machine with at least two water tubs and more particularly to an automatic feeding device applied to the above-mentioned multi-drum washing machine and used for adding an additive in a clothes treatment process.

BACKGROUND

Additives such as a detergent, a softener and a disinfectant used in a washing process of a traditional washing machine are separated from the washing machine, and no additive feeding device is arranged on the washing machine, so that the additives can not be automatically fed, and a fully-automatic washing control process of the washing machine may not be realized by using the structure. With the improvement of the automation level of the washing machine, most of washing machines are set in a way that an additive box for holding the detergent or/and the softener communicates with a water inlet pipeline, the detergent or/and the softener in the additive box are flushed into water tubs by inlet water, however, the structure has the defect that the detergent or/and the softener have to be firstly placed into the additive box every time during washing, and the fully-automatic washing control process is still not realized.

At present, there have been a great number of patent applications related to an automatic additive feeding device. A Chinese patent with the application number of 97208723.0 discloses a detergent adding device of a washing machine, which is characterized in that a box body of the washing machine is provided with an accommodating cavity matched with a bottle, the bottom of the accommodating cavity is provided with a conical through hole in which a vertical fixing plate is fixed, a detergent conduit is fixed by the vertical fixing plate, a bottle body is matched with the accommodating cavity, a bottleneck is provided with a conical introduction pipe, and the bottom of the bottle body is provided with a ventilation opening. The structure is incapable of controlling the addition amount of the detergent and is easy to damage, thereby wasting the detergent.

A Chinese patent with the application number of 200610136059.9 discloses a detergent supply device of a washing machine with a detergent box provided with a siphon unit, which is characterized in that a detergent is injected into the detergent box, and then, washing water is injected into the detergent box to dilute the detergent in the box and the diluted detergent is then discharged from the siphon unit to a washing tub. According to the disclosure, the problem that a thick detergent directly enters the washing tub to damage washed clothes is solved, but an additive such as the detergent may not be precisely controlled.

Meanwhile, with the improvement of living conditions of people, an applicant previously proposed a multi-drum washing machine to meet the demands of users on diversity and high requirements of clothes treatment. The washing machine is provided with a plurality of water tubs arranged to be independent from each other and capable of respectively treating clothes, so that the demands of the users on respective treatment of the different clothes and diversified and individual treatment of the different clothes are met. Therefore, how to arrange an automatic feeding device to respectively feed the corresponding additives in the different water tubs by virtue of inlet water of the washing machine is a problem urgent to be solved.

For this purpose, the present disclosure is proposed.

SUMMARY

A purpose of the present disclosure is to provide an automatic feeding device to automatically feed additives to different feeding points by using a set of device; another purpose of the present disclosure is to provide an automatic feeding device and method to respectively and automatically feed additives to different feeding points by virtue of a single inlet water flow; and a further purpose of the present disclosure is to provide a multi-drum washing machine to respectively and automatically feed different types of additives into different water tubs.

In order to achieve the above-mentioned purposes, a specific technical solution adopted in the present disclosure is described as follows:

provided is an automatic feeding device, including a water supply pipeline, provided with at least two water outlets and capable of controllably and reversibly delivering inlet water to any one of the water outlets; liquid storage parts, containing additives; and a pumping structure, capable of generating a negative pressure by virtue of a water flow flowing through the water supply pipeline to pump out the additives in the liquid storage parts and delivery the additives to the selected water outlet with the water flow.

Further, the automatic feeding device further includes a flushing pipeline, wherein at least a part of the water flow at a water outlet end of the water supply pipeline is directly introduced to the pumping structure by the flushing pipeline to perform flushing, and then returns to the water supply pipeline by virtue of the pumping structure; preferably, the flushing pipeline is provided with a one-way valve for ensuring that the water flow in the pipeline flows from a water inlet end to the water outlet end in a single direction; and preferably, the flushing pipeline is provided with a control valve for controlling the water flow to flow in the pipeline or not.

Further, the automatic feeding device includes at least two liquid storage parts, wherein each of the liquid storage parts communicates with a pumping port of the pumping structure by a different connecting pipeline, and each of the connecting pipelines is provided with a control valve for controlling the on/off of the pipeline; or, each of the liquid storage parts is connected with the same connecting pipeline by a reversing valve, and one of the liquid storage parts is enabled to communicate with the connecting pipeline under the action of the reversing valve. Preferably, two ends of the connecting pipeline respectively communicate with the water outlet end of the flushing pipeline and the pumping port of the pumping structure; the connecting pipeline is connected in series with a plurality of reversing valves, and the other reversing port of each of the reversing valves communicates with each of the liquid storage parts in a one-to-one correspondence way; and when any one of the reversing valves is switched to enable the corresponding liquid storage part to communicate with the pumping port of the pumping structure, the two reversing ports, communicating with the connecting pipeline, of the reversing valve are disconnected.

Further, each of the connecting pipelines communicates with the water supply pipeline by a corresponding different flushing pipeline; or, each of the connecting pipelines is connected with the same flushing pipeline by a reversing structure, and the flushing pipeline is enabled to communicate with one of the connecting pipelines under the action of the reversing structure. Preferably, the connecting pipeline is provided with a metering device for detecting a flow of a liquid flowing through the pipeline; and preferably, the connecting pipeline is provided with a one-way valve for ensuring that the liquid in the pipeline flows to one end of the pumping port of the pumping structure in a single direction.

Further, the water outlet end of the water supply pipeline communicates with a first water outlet or a second water outlet by a reversing valve; or, the water outlet end of the water supply pipeline is respectively connected with the first water outlet and the second water outlet by two different pipelines, and each of the two pipelines is provided with a control valve for controlling the on/off of the pipeline. Preferably, the water supply pipeline is provided with a one-way valve for ensuring the water flow in the pipeline flows from a water inlet source end to the water outlet end in a single direction.

Further, the pumping structure includes a venturi tube arranged in the water supply pipeline and capable of generating a negative pressure by virtue of the flowing of the water flow, and a negative pressure region of the venturi tube is provided with a pumping port communicating with the liquid storage parts and used for pumping the additives into the water flow of the water supply pipeline by virtue of the negative pressure; preferably, two ends of the venturi tube are both connected into the water supply pipeline and respectively and correspondingly communicate with the water inlet end and the water outlet end; and the middle of the venturi tube is provided with a necking part of which the inner wall tube diameter is suddenly reduced, the flow rate of the water flow flowing through the necking part is suddenly increased to generate a negative pressure to form a negative pressure region, the negative pressure region is provided with a port communicating with the outside, and the port forms the pumping port, communicating with the liquid storage parts by virtue of the connecting pipelines, of the pumping structure.

Further, the connecting pipeline located between each of the liquid storage parts and the pumping structure is provided with a labyrinth loop arranged to be swirled and capable of extending the axial length of the pipeline. Preferably, each of the connecting pipelines communicates with the pumping port of the pumping structure by the same labyrinth loop; preferably, the metering device for detecting the flow of the flowing liquid is arranged between the labyrinth loop and the pumping port of the pumping structure; and preferably, the labyrinth loop communicates with the pumping port of the pumping structure by a pipeline provided with a control valve, and the control valve controls the on/off of the pipeline.

The present disclosure further provides a control method of the automatic feeding device. When the additives are fed, a water flow at a water supply source flows to one of the water outlets by the water supply pipeline, the additives in the liquid storage parts are pumped out by virtue of a negative pressure generated when the water flow flows through the pumping structure, enter the water supply pipeline from the pumping port, and are then flushed into the corresponding water outlet with the water flow in the water supply pipeline.

Further, when the pumping structure is flushed, the water supply pipeline communicates with the flushing pipeline, the liquid storage parts are disconnected with the pumping structure, and the water flow in the water supply pipeline flows to the pumping structure by the flushing pipeline, and then returns to the water supply pipeline by the pumping port of the pumping structure; and preferably, when the pumping structure is flushed, the water outlet end of the water supply pipeline communicates with the flushing pipeline and one of the water outlets, a part of the water flow in the water supply pipeline flows to one of the water outlets, the other part of the water flow flows to the flushing pipeline, and after the pumping structure is flushed by the flushing pipeline, flushing water returning from the pumping port to the flushing pipeline may flow out of one of the water outlets.

The present disclosure further provides a multi-drum washing machine, including at least two water tubs, wherein the multi-drum washing machine is provided with the above-mentioned automatic feeding device, each of the water outlets of the automatic feeding device communicates with each of the water tubs in a one-to-one correspondence way, so that the additives pumped out of the liquid storage parts by the pumping structure are controllably delivered to any one of the water tubs.

Further, the water inlet end of the water supply pipeline of the automatic feeding device communicates with a water inlet structure of the washing machine, and washing water supplied by the water inlet structure of the washing machine is used as the water supply source at the water inlet end of the water supply pipeline; and the water outlet end of the water supply pipeline controllably and reversibly communicates with the corresponding water tub by any one of the water outlets, so that the additives pumped into the water supply pipeline flow into the corresponding water tub with an inlet water flow of the washing machine.

Compared with the prior art, the present disclosure has the following beneficial effects:

due to the above-mentioned arrangement, the additives may be fed to one of the corresponding water outlets by the automatic feeding device by virtue of the pumping structure, so that the aim that the additives are respectively fed to a plurality of positions by using a set of system is achieved; and meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved.

In order to achieve the above-mentioned purposes, another specific technical solution adopted in the present disclosure is described as follows:

provided is an automatic feeding device, including liquid storage parts, containing additives; and at least two water supply pipelines, capable of respectively delivering inlet water to water outlets of the corresponding water supply pipelines, wherein each of the water supply pipelines is provided with a pumping structure capable of generating a negative pressure by virtue of a water flow flowing through the corresponding water supply pipeline to pump out the additives in the liquid storage parts and deliver the additives to the water outlet of the corresponding water supply pipeline with the water flow.

Further, the automatic feeding device further includes a flushing pipeline, wherein water flows at water outlet ends of the water supply pipelines are directly introduced to the pumping structures through the flushing pipeline to perform flushing, and then, flushing water returns to the water supply pipelines by virtue of the pumping structures. Preferably, the flushing pipeline is provided with a one-way valve for ensuring that the water flow in the pipeline flows from a water inlet end to the water outlet end in a single direction;

and preferably, the flushing pipeline is provided with a control valve for controlling the water flow to flow in the pipeline or not.

Further, the water outlet end of each of the water supply pipelines is connected with each of the pumping structures in a one-to-one correspondence way by a different flushing pipeline; or, the water outlet end of any one of the water supply pipelines communicates with the water inlet end of one of the flushing pipelines, and the water outlet end of the flushing pipeline communicates with one of the pumping structures by a reversing valve; or, the water outlet end of any one of the water supply pipelines communicates with the water inlet end of one of the flushing pipelines, and the water outlet end of the flushing pipeline is connected with each of the pumping structures in a one-to-one correspondence way by a pipeline provided with a control valve; or, the water outlet end of each of the water supply pipelines is correspondingly connected, by one of the flushing pipelines, with the pumping structure arranged on the water supply pipeline.

Further, the automatic feeding device includes at least two liquid storage parts, wherein each of the liquid storage parts is connected with a pumping port of each of the pumping structures in a one-to-one correspondence way by a different connecting pipeline, and each of the connecting pipelines is provided with a control valve for controlling the on/off of the pipeline; or, one of the at least two liquid storage parts communicates with the same connecting pipeline by a reversing valve; or, the at least two liquid storage parts respectively communicate with the same connecting pipeline by pipelines provided with control valves. Preferably, the water outlet end of the connecting pipeline communicates with the pumping port of one of the at least two pumping structures by a reversing valve; or, the water outlet end of the connecting pipeline respectively communicates with the pumping ports of the at least two pumping structures by pipelines provided with control valves.

Further, each of the connecting pipelines communicates with each of the water supply pipelines by a different flushing pipeline in one-to-one correspondence to each of the connecting pipelines; or, each of the connecting pipelines is connected with the same flushing pipeline by a reversing structure, and the flushing pipeline is enabled to communicate with one of the connecting pipelines under the action of the reversing structure; or, each of the water supply pipelines is connected with one of the corresponding flushing pipelines, each of the flushing pipelines is connected with one of the connecting pipelines by a reversing valve, and one of the flushing pipelines is enabled to communicate with the connecting pipeline under the action of the reversing structure. Preferably, the connecting pipeline is provided with a metering device for detecting a flow of a liquid flowing through the pipeline; and preferably, the connecting pipeline is provided with a one-way valve for ensuring that the liquid in the pipeline flows to one end of the pumping port of each of the pumping structures in a single direction.

Further, the water outlet end of each of the water supply pipelines communicates with the different water outlets in one-to-one correspondence to the water outlet ends; and preferably, the water supply pipelines are provided with one-way valves for ensuring the water flows in the pipelines flow from water inlet source ends to the water outlet ends in a single direction.

Further, each of the pumping structures includes a venturi tube arranged in each of the water supply pipelines and capable of generating a negative pressure by virtue of the flowing of the water flow, and a negative pressure region is provided with a pumping port communicating with each of the liquid storage parts and used for pumping the additives into the water flow of the water supply pipeline by virtue of the negative pressure; preferably, two ends of the venturi tube are both connected into the corresponding water supply pipeline and respectively and correspondingly communicate with the water inlet end and the water outlet end; and the middle of the venturi tube is provided with a necking part of which the inner wall tube diameter is suddenly reduced, a negative pressure is generated at the necking part with the sudden increase of the flow rate of the water flow to form a negative pressure region, the negative pressure region is provided with a port communicating with the outside, and the port forms the pumping port, communicating with the liquid storage parts by the connecting pipelines, of the pumping structure.

Further, the connecting pipeline located between each of the liquid storage parts and each of the pumping structures is provided with a labyrinth loop arranged to be swirled and capable of extending the axial length of the pipeline; preferably, each of the connecting pipelines communicates with the pumping ports of the pumping structures by the same labyrinth loop; preferably, the metering device for detecting the flow of the flowing liquid is arranged between the labyrinth loop and the pumping port of each of the pumping structures; and preferably, the labyrinth loop communicates with the pumping ports of the pumping structures by pipelines provided with control valves, and the control valves control the on/off of the pipelines.

Another purpose of the present disclosure is to provide a control method of the automatic feeding device. When the additives are fed, a water flow at a water supply source flows to the corresponding water outlet by any one of the water supply pipelines, the additives in the liquid storage parts are pumped out by virtue of a negative pressure generated when the water flow flows through the pumping structure arranged on the water supply pipeline, enter the corresponding water supply pipeline by the pumping port, and are then flushed into the corresponding water outlet with the water flow in the water supply pipeline.

Further, when the pumping structures are flushed, the water supply pipelines communicate with the flushing pipeline, the liquid storage parts are disconnected with the pumping structures, water flows flow through the water supply pipelines, and at least parts of the water flows flowing through the water supply pipelines flow to the pumping structures through the flushing pipeline to perform flushing, and then, flushing water returns to the water supply pipelines by the pumping ports of the pumping structures. Preferably, when the pumping structures are flushed, the water outlet ends of the water supply pipelines communicate with the flushing pipeline and one of the water outlets, parts of the water flows in the water supply pipelines flow to one of the water outlets, and the other parts of the water flows flow to the flushing pipeline, and after the pumping structures are flushed by the flushing pipeline, flushing water returning from the pumping ports to the flushing pipeline may flow out of one of the water outlets.

The present disclosure further introduces a multi-drum washing machine, including at least two water tubs, wherein the multi-drum washing machine is provided with the above-mentioned automatic feeding device, each of the water outlets of the automatic feeding device communicates with each of the water tubs in a one-to-one correspondence way, so that the additives pumped out of the liquid storage parts by the pumping structures are controllably delivered to any one of the water tubs.

Further, the water inlet end of each of the water supply pipelines of the automatic feeding device communicates with a water inlet structure of the washing machine, and washing water supplied by the water inlet structure of the washing machine is used as the water supply source at the water inlet end of each of the water supply pipelines; and the water outlet end of each of the water supply pipelines controllably and reversibly communicates with the corresponding water tub by one of the water outlets, so that the additives pumped into the corresponding water supply pipeline flow into the corresponding water tub with an inlet water flow of the washing machine.

Compared with the prior art, the present disclosure has the following beneficial effects:

due to the above-mentioned arrangement, the additives may be fed to the corresponding water outlets by the automatic feeding device by virtue of the different pumping structures, so that the aim that the additives are respectively fed to a plurality of positions by using a set of system is achieved; and meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved.

In order to achieve the above-mentioned purposes, a further specific technical solution adopted in the present disclosure is described as follows:

provided is an automatic feeding device, including at least two water outlets; liquid storage parts, containing additives; and at least two water supply pipelines, capable of controllably and reversibly delivering inlet water to any one of the water outlets, wherein each of the water supply pipelines is provided with a pumping structure capable of generating a negative pressure by virtue of a water flow flowing through the corresponding water supply pipeline to pump out the additives in the liquid storage parts and deliver the additives to the selected water outlet along the corresponding water supply pipeline with the water flow.

Further, the automatic feeding device further includes a flushing pipeline, wherein water flows at water outlet ends of the water supply pipelines are directly introduced to the pumping structures through the flushing pipeline to perform flushing, and then, flushing water returns to the water supply pipelines by virtue of the pumping structures; preferably, the flushing pipeline is provided with a one-way valve for ensuring that the water flow in the pipeline flows from a water inlet end to the water outlet end in a single direction; and preferably, the flushing pipeline is provided with a control valve for controlling the water flow to flow in the pipeline or not.

Further, the water outlet end of each of the water supply pipelines is connected with each of the pumping structures in a one-to-one correspondence way by a different flushing pipeline; or, the water outlet end of any one of the water supply pipelines communicates with the water inlet end of one of the flushing pipelines, and the water outlet end of the flushing pipeline communicates with one of the pumping structures by a reversing valve; or, the water outlet end of any one of the water supply pipelines communicates with the water inlet end of one of the flushing pipelines, and the water outlet end of the flushing pipeline is connected with each of the pumping structures in a one-to-one correspondence way by a pipeline provided with a control valve; or, the water outlet end of each of the water supply pipelines is correspondingly connected, by one of the flushing pipelines, with the pumping structure arranged on the water supply pipeline.

Further, the automatic feeding device includes at least two liquid storage parts, wherein each of the liquid storage parts is connected with a pumping port of each of the pumping structures in a one-to-one correspondence way by a different connecting pipeline, and each of the connecting pipelines is provided with a control valve for controlling the on/off of the pipeline; or, one of the at least two liquid storage parts communicates with the same connecting pipeline by a reversing valve; or, the at least two liquid storage parts respectively communicate with the same connecting pipeline by pipelines provided with control valves.

Preferably, the water outlet end of the connecting pipeline communicates with the pumping port of one of the at least two pumping structures by a reversing valve; or, the water outlet end of the connecting pipeline respectively communicates with the pumping ports of the at least two pumping structures by pipelines provided with control valves.

Further, each of the connecting pipelines communicates with each of the water supply pipelines by a different flushing pipeline in one-to-one correspondence to each of the connecting pipelines; or, each of the connecting pipelines is connected with the same flushing pipeline by a reversing structure, and the flushing pipeline is enabled to communicate with one of the connecting pipelines under the action of the reversing structure; or, each of the water supply pipelines is connected with one of the corresponding flushing pipelines, one of the flushing pipelines is connected with one of the connecting pipelines by a reversing valve, and one of the flushing pipelines is enabled to communicate with the connecting pipeline under the action of the reversing structure.

Further, the connecting pipeline is provided with a metering device for detecting a flow of a liquid flowing through the pipeline.

Further, the connecting pipeline is provided with a one-way valve for ensuring that the liquid in the pipeline flows to one end of the pumping port of each of the pumping structures in a single direction.

Further, the water outlet end of each of the water supply pipelines is connected with each of the water outlets by a reversing structure, and one of the water supply pipelines is enabled to communicate with each of the water outlets under the action of the reversing structure; or, the water outlet end of each of the water supply pipelines is connected with each of the water outlets in a one-to-one correspondence way by a different pipeline; and each of the pipelines is provided with a control valve for controlling the on/off of the pipeline; preferably, the water supply pipelines are provided with one-way valves for ensuring the water flows in the pipelines flow from water inlet source ends to the water outlet ends in a single direction.

Further, each of the pumping structures includes a venturi tube arranged in each of the water supply pipelines and capable of generating a negative pressure by virtue of the flowing of the water flow, and a negative pressure region is provided with a pumping port communicating with each of the liquid storage parts and used for pumping the additives into the water flow of the water supply pipeline by virtue of the negative pressure; preferably, two ends of the venturi tube are both connected into the corresponding water supply pipeline and respectively and correspondingly communicate with the water inlet end and the water outlet end; and the middle of the venturi tube is provided with a necking part of which the tube diameter is suddenly reduced, a negative pressure is generated at the necking part with the sudden increase of the flow rate of the water flow to form a negative pressure region, the negative pressure region is provided with a port communicating with the outside, and the port forms the pumping port, communicating with each of the liquid storage parts by the connecting pipelines, of the pumping structure.

Further, the connecting pipeline located between each of the liquid storage parts and each of the pumping structures is provided with a labyrinth loop arranged to be swirled and capable of extending the axial length of the pipeline; preferably, each of the connecting pipelines communicates with the pumping ports of the pumping structures by the same labyrinth loop; preferably, the metering device for detecting the flow of the flowing liquid is arranged between the labyrinth loop and the pumping port of each of the pumping structures; and preferably, the labyrinth loop communicates with the pumping ports of the pumping structures by pipelines provided with control valves, and the control valves control the on/off of the pipelines.

Another purpose of the present disclosure is to provide a control method of the automatic feeding device. When the additives are fed, a water flow at a water supply source flows to one of the water outlets by any one of the water supply pipelines, the additives in the liquid storage parts are pumped out by virtue of a negative pressure generated when the water flow flows through the pumping structure arranged on the water supply pipeline, enter the corresponding water supply pipeline by the pumping port, and are then flushed into the corresponding water outlet with the water flow in the water supply pipeline.

Further, when the pumping structures are flushed, the water supply pipelines communicate with the flushing pipeline, the liquid storage parts are disconnected with the pumping structures, water flows flow through the water supply pipelines, and at least parts of the water flows flowing through the water supply pipelines flow to the pumping structures through the flushing pipeline to perform flushing, and then, flushing water returns to the water supply pipelines by the pumping ports of the pumping structures. Preferably, when the pumping structures are flushed, the water outlet ends of the water supply pipelines communicate with the flushing pipeline and one of the water outlets, parts of the water flows in the water supply pipelines flow to one of the water outlets, and the other parts of the water flows flow to the flushing pipeline, and after the pumping structures are flushed by the flushing pipeline, flushing water returning from the pumping ports to the flushing pipeline may flow out of one of the water outlets.

The present disclosure introduces a multi-drum washing machine, including at least two water tubs, wherein the multi-drum washing machine is provided with any one of the above-mentioned automatic feeding devices, each of the water tubs communicates with each of the water outlets, in one-to-one correspondence to the water tubs, of the automatic feeding device, so that the additives pumped out of the liquid storage parts by the pumping structure are controllably delivered to any one of the water tubs.

Further, the water inlet end of each of the water supply pipelines of the automatic feeding device communicates with a water inlet structure of the washing machine, and washing water supplied by the water inlet structure of the washing machine is used as the water supply source at the water inlet end of each of the water supply pipelines; and the washing water controllably and reversibly flows into one of the water supply pipelines and controllably and reversibly flows from the water outlet end of the water supply pipeline into the corresponding water tub by one of the water outlets, so that the additives pumped into the corresponding water supply pipeline flow into the corresponding water tub with an inlet water flow of the washing machine.

Compared with the prior art, the present disclosure has the following beneficial effects:

due to the above-mentioned arrangement, the additives may be controllably fed to one of the corresponding water outlets by the automatic feeding device by virtue of the different pumping structures, so that the aim that the additives are respectively fed to a plurality of positions by using a set of system is achieved; and meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved.

Meanwhile, the automatic feeding device and the multi-drum washing machine of the present disclosure are simple in structure, remarkable in effect and suitable for popularization and use.

BRIEF DESCRIPTION OF THE DRAWINGS

The present disclosure is described in detail below in conjunction with the accompanying drawings.

DESCRIPTION FOR MAIN ELEMENTS

Figure 1:
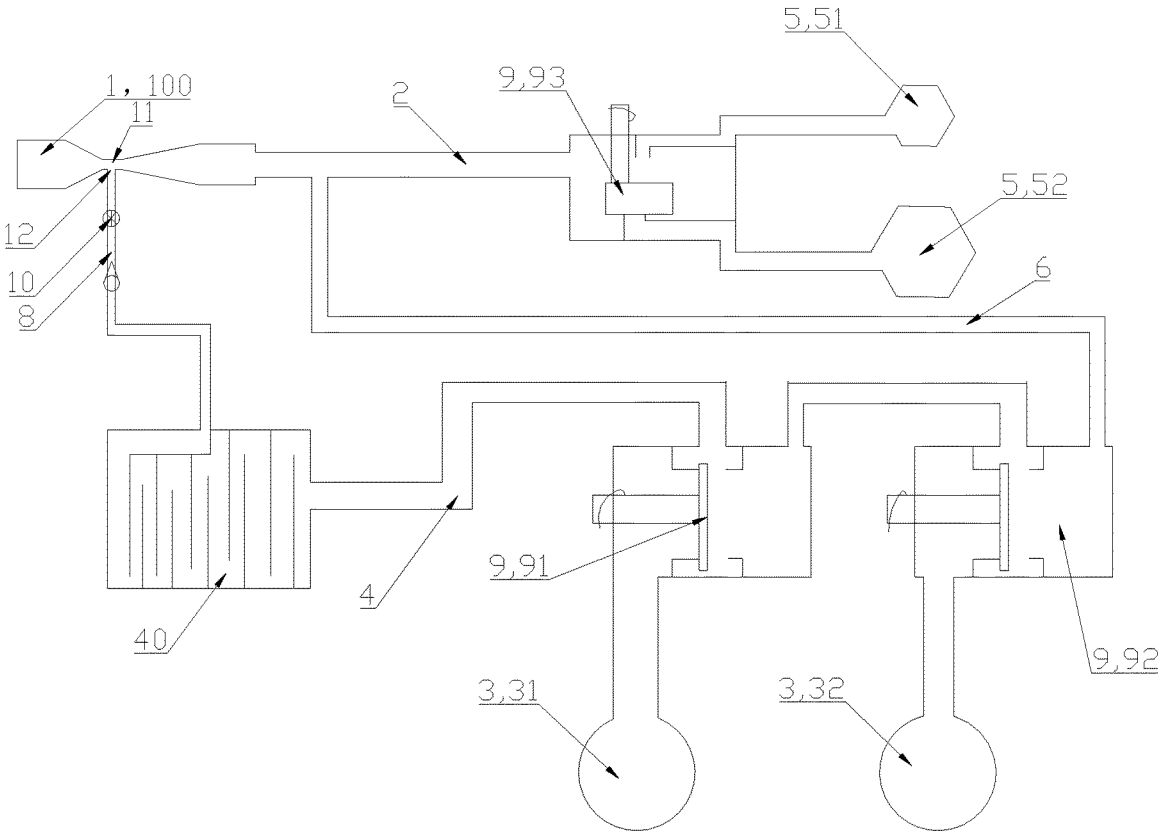
FIG. 1 to FIG. 12 are schematic diagrams showing structures of automatic feeding devices in different embodiments of the present disclosure.

1—pumping structure, 2—water supply pipeline, 3—liquid storage part, 4—connecting pipeline, 5—water tub, 6—flushing pipeline, 7—control valve, 8—one-way valve, 9—reversing valve, 10—metering device, 11—negative pressure region, 12—pumping port, 100—venturi tube, and 40—labyrinth loop.

DETAILED DESCRIPTION

Embodiment 1

As shown in FIG. 1-FIG. 4, the embodiment of the present disclosure introduces a multi-drum washing machine, including a plurality of water tubs 5 arranged to be independent from each other, wherein each of the water tubs 5 is capable of respectively treating clothes; the washing machine is provided with a water inlet structure for introducing an external water flow to the inside of the washing machine; and the washing machine is further provided with an automatic feeding device for feeding additives into the corresponding water tubs 5 with an inlet water flow flowing with the water inlet structure so as to treat the clothes in the corresponding water tubs 5 by using the additives fed with the inlet water flow.

In the embodiment of the present disclosure, the additives include, but are not limited to the following additives: a detergent, a softener, a disinfectant, a flavoring agent and a bleaching agent.

As shown in FIG. 1 to FIG. 4, the embodiment of the present disclosure further introduces an automatic feeding device. The automatic feeding device may be applied to the above-mentioned multi-drum washing machine and used for feeding the additives into the corresponding water tubs 5 of the washing machine; and the automatic feeding device may also be applied to any existing equipment to feed the corresponding additives into any waterway channel of the equipment.

The automatic feeding device in the embodiment of the present disclosure includes a water supply pipeline 2, provided with at least two water outlets and capable of controllably delivering a water flow at a water supply source at a water inlet end to one of the water outlets; liquid storage parts 3, containing additives used when clothes are treated; and a pumping structure 1, capable of pumping the additives in the liquid storage parts 3 to the water supply pipeline 2 and enabling the additives to flow to the corresponding water outlets of the water supply pipeline 2 with the water flow. In the embodiment of the present disclosure, when the automatic feeding device is mounted on a multi-drum washing machine, the water outlets of the automatic feeding device communicate with the water tubs 5 of the washing machine in a one-to-one correspondence way, a water supply source is supplied by the water inlet structure of the washing machine, so that the additives are fed into the corresponding water tubs 5 together with the inlet water flow in a process that washing water enters the corresponding water tubs 5 of the multi-drum washing machine. Of course, for meeting the design demand of the washing machine, the number of the water outlets of the automatic feeding device may also be set to be different from that of the water tubs to ensure that at least one of the water tubs corresponds to a plurality of the water outlets, or at least one of the water outlets corresponds to a plurality of the water tubs.

Due to the above-mentioned arrangement, the additives may be fed to one of the corresponding water outlets by the automatic feeding device by virtue of the pumping structure, so that the aim that the additives are respectively fed to a plurality of positions by using a set of system is achieved. Meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved.

The automatic feeding device in the embodiment of the present disclosure further includes a flushing pipeline 6; the water flow at a water outlet end of the water supply pipeline 2 is directly introduced to the pumping structure 1 by the flushing pipeline 6, and then circularly returns to the water supply pipeline 2 by virtue of the pumping structure 1, and the pumping structure 1 is flushed by using circulating water, so that residual additives in the pipeline are flushed by using flushing water after the additives are fed once by the automatic feeding device, and furthermore, it is ensured that the additives fed when the automatic feeding device is started every time are all discharged into the water supply pipeline with the water flow; and meanwhile, the aim of flushing the automatic feeding device to prevent the residual additives from affecting the subsequence use of the device is achieved. Preferably, the flushing pipeline 6 may be provided with a one-way valve 8 for ensuring a water flow in the pipeline flows from a water inlet end to the water outlet end in a single direction; and preferably, the flushing pipeline 6 may be provided with a control valve 7 for controlling the water flow to flow in the pipeline or not.

The automatic feeding device in the embodiment of the present disclosure includes at least two liquid storage parts 3, wherein different types of additives may be respectively stored in the liquid storage parts 3. Each of the liquid storage parts 3 communicates with a pumping port of the pumping structure 1 by a different connecting pipeline 4, and each of the connecting pipelines 4 is provided with a control valve 7 for controlling the on/off of the pipeline; or, each of the liquid storage parts 3 is connected with the same connecting pipeline 4 by a reversing valve 9, and each of the liquid storage parts 3 is enabled to communicate with one of the connecting pipelines 4 under the action of the reversing valve 9; or, two ends of the connecting pipeline 4 respectively communicate with the water outlet end of the flushing pipeline 6 and the pumping port of the pumping structure 1; the connecting pipeline 4 is connected in series with a plurality of reversing valves 9, and the other reversing port of each of the reversing valves 9 communicates with each of the liquid storage parts 3 in a one-to-one correspondence way; and when any one of the reversing valves 9 is switched to enable the corresponding liquid storage part 3 to communicate with the pumping port 12 of the pumping structure 1, the two reversing ports, communicating with the connecting pipeline 4, of the reversing valve 9 are disconnected. Therefore, the pumping structure 1 of the automatic feeding device controllably communicates with one of the liquid storage parts 3, so that the aim that the different types of additives are fed by the automatic feeding device is achieved.

Embodiment 2

As shown in FIG. 1, the present embodiment introduces an automatic feeding device, including a water supply pipeline 2, wherein a water inlet end of the water supply pipeline 2 communicates with a water inlet structure of a multi-drum washing machine, a water outlet end of the water supply pipeline 2 is provided with at least two water outlets, each of the water outlets communicates with water tubs 5 of the washing machine in a one-to-one correspondence way to enable an inlet water flow of the washing machine to be controllably delivered to one of the water tubs 5 by the water supply pipeline 2 of the automatic feeding device, so that the aim that washing water enters any one of the water tubs 5 of the multi-drum washing machine is achieved. The water inlet end of the water supply pipeline 2 communicates with liquid storage parts 3 by a pumping structure 1; the liquid storage parts 3 contain additives used when clothes are treated; and a pumping port 12 of the pumping structure 1 communicates with the liquid storage parts 3 by a connecting pipeline 4 to ensure that the additives in the liquid storage parts 3 are pumped to the water supply pipeline 2 by the pumping structure 1 and the additives are enabled to flow to the corresponding water tub 5 with an inlet water flow flowing through the water supply pipeline 2, so that the aim that the additives flow to the corresponding water tub 5 with the inlet water flow so as to be automatically fed is achieved.

In the present embodiment, the pumping structure 1 includes a venturi tube 100 arranged in the water supply pipeline and capable of generating a negative pressure by virtue of the flowing of the water flow, and a negative pressure region 11 is provided with a pumping port 12 communicating with the liquid storage parts 3 and used for pumping the additives into the water flow of the water supply pipeline by virtue of the negative pressure. In the present embodiment, two ends of the venturi tube 100 are both connected into the water supply pipeline 2 and respectively and correspondingly communicate with the water inlet end and the water outlet end; and the middle of the venturi tube 100 is provided with a necking part of which the inner tube diameter is suddenly reduced. Since the tube wall inner diameter of the necking part is suddenly reduced, the flow rate of the water flow in the region is suddenly increased so that the necking part forms a negative pressure region 11 where a negative pressure is generated with the flowing of the water flow, the negative pressure region 11 is provided with a port communicating with the outside, and the port forms the pumping port 12, communicating with the liquid storage parts 3 by a connecting pipeline 4, of the pumping structure 1. Due to the above-mentioned arrangement, the pumping structure is enabled to be directly composed of the venturi tube generating a negative pressure pumping effect with the change of the flow rate of the water flow, so that the aim that the additives stored in the liquid storage parts are pumped into the inlet water flow with the inlet water flow is achieved.

In the present embodiment, the water outlet end of the water supply pipeline 2 is connected with a reversing valve 9 which is a third reversing valve 93; the third reversing valve 93 is a valve body with one inlet and a plurality of outlets, the inlet of the third reversing valve 93 communicates with the water outlet end of the water supply pipeline 2, each of the outlets of the third reversing valve 93 communicates with each of the water tubs 5 in a one-to-one correspondence way, the inside of the third reversing valve 93 is provided with a switchable valve element, so that the inlet of the third reversing valve 93 communicates with any one of the outlets, the water outlet end of the water supply pipeline 2 is enabled to communicate with one of the water tubs 5 under the action of the third reversing valve 93, and furthermore, the aim that the corresponding water tub 5 is supplied with water and fed with the additives is achieved.

In the present embodiment, the automatic feeding device further includes a flushing pipeline 6; the water inlet end of the flushing pipeline 6 communicates with a part, located at the downstream of the venturi tube 100 and the upstream of the third reversing valve 93, of the water supply pipeline 2, the water outlet end of the flushing pipeline 6 communicates with one end of the connecting pipeline 4, and the other end of the connecting pipeline 4 communicates with the pumping port of the pumping structure 1. Due to the above-mentioned arrangement, a water flow at a water outlet end of the water supply pipeline is directly introduced to the pumping structure, and then circularly returns to the water supply pipeline by virtue of the pumping structure, and the pumping structure is flushed by using circulating water, so that the residual additives in the pipeline are flushed by using flushing water after the additives are fed once by the automatic feeding device, and furthermore, it is ensured that the additives fed when the automatic feeding device is started every time are all discharged into the water supply pipeline with the water flow; and meanwhile, the aim of flushing the automatic feeding device to prevent the residual additives from affecting the subsequence use of the device is achieved. Preferably, the flushing pipeline 6 may be provided with a one-way valve 8 for ensuring the water flow in the pipeline flows from a water inlet end to the water outlet end in a single direction; and preferably, the flushing pipeline 6 may be provided with a control valve 7 for controlling the water flow to flow in the pipeline or not.

In the present embodiment, the automatic feeding device includes at least two liquid storage parts 3, wherein the liquid storage parts 3 are respectively fed with different types of additives, so that the aim that the different types of additives are automatically fed by classification by the automatic feeding device is achieved.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 1, in the present embodiment, one end of the connecting pipeline 4 communicates with the pumping port 12 of the venturi tube 100, and the other end of the connecting pipeline 4 communicates with the water outlet end of the flushing pipeline 6; the connecting pipeline 4 is sequentially connected in series with two reversing valves 9 which are respectively a first reversing valve 91 and a second reversing valve 92; each of the first reversing valve 91 and the second reversing valve 92 is a valve body provided with two inlets and one outlet, and the inlets are enabled to respectively communicate with the two outlets under the actions of valve elements inside the valve bodies; the first inlet and the outlet of each of the first reversing valve 91 and the second reversing valve 92 are both formed in the connecting pipeline 4, and the outlets arranged in the reversing valve 9 are closer to the end, communicating with the venturi tube 100, of the connecting pipeline 4 than the first inlets; and the second inlets of the first reversing valve 91 and the second reversing valve 92 respectively communicate with the first liquid storage part 31 and the second liquid storage part 32 in a one-to-one correspondence way.

When an additive in the first liquid storage part 31 is fed, the automatic feeding device is in the following state:

the outlet of the first reversing valve 91 communicates with the second inlet and is disconnected with the first inlet, at the moment, the first liquid storage part 31 communicates with the pumping port 12 of the venturi tube 100 by the connecting pipeline 4, the additive in the first liquid storage part 31 is pumped into the water supply pipeline 2 with the inlet water flow and flows into the corresponding water tub 5 with the water flow in the water supply pipeline 2.

When an additive in the second liquid storage part 32 is fed, the automatic feeding device is in the following state:

the outlet of the first reversing valve 91 communicates with the first inlet and is disconnected with the second inlet, and the outlet of the second reversing valve 92 communicates with the second inlet and is disconnected with the first inlet, at the moment, the second liquid storage part 32 communicates with the pumping port 12 of the venturi tube 100 by the connecting pipeline 4, the additive in the second liquid storage part 32 is pumped into the water supply pipeline 2 with the inlet water flow and flows into the corresponding water tub 5 with the water flow in the water supply pipeline 2.

When the pumping structure 1 is flushed, the automatic feeding device is in the following state:

the outlet of the first reversing valve 91 communicates with the first inlet and is disconnected with the second inlet, and the outlet of the second reversing valve 92 communicates with the first inlet and is disconnected with the second inlet, at the moment, the connecting pipeline 4 communicates with the flushing pipeline 6, the inlet water flow in the water supply pipeline 2 directly flows into the connecting pipeline 4 through the flushing pipeline 6, returns to the water supply pipeline 2 by the pumping port 12 of the venturi tube 100 after flushing the connecting pipeline 4, and then flows from the water outlet end of the water supply pipeline 2 to the corresponding water tub 5, so that the aim that the residual additives in the connecting pipeline 4 and the venturi tube 100 are flushed is achieved.

In the present embodiment, in order to increase the feeding amount of the additives fed once by the automatic feeding device, the connecting pipeline 4 is provided with a labyrinth loop 40; and the labyrinth loop 40 is composed of a flow channel arranged to be swirled and capable of extending the axial length of the pipeline, and two ends of the flow channel respectively communicate with the liquid storage parts 3 and the pumping port 12 of the pumping structure 1.

In the present embodiment, in order to realize metering detection of the feeding amount of the additives, an arrangement may be made as follows: the connecting pipeline 4 located between the labyrinth loop 40 and the pumping port 12 of the pumping structure is provided with a metering device 10 for detecting the flow of a flowing liquid.

In the present embodiment, in order to avoid the situation that the water flow in the water supply pipeline flows from the pumping port 12 back to the connecting pipeline 4, an arrangement may be made as follows: the connecting pipeline 4 located between the labyrinth loop 40 and the pumping port 12 of the venturi tube is provided with a one-way valve 8, and the one-way valve 8 controls the flow direction of the liquid in the pipeline so as to ensure that the liquid in the connecting pipeline 4 may only flow to the pumping port 12 of the venturi tube along the liquid storage parts 3.

Embodiment 3

Figure 2:
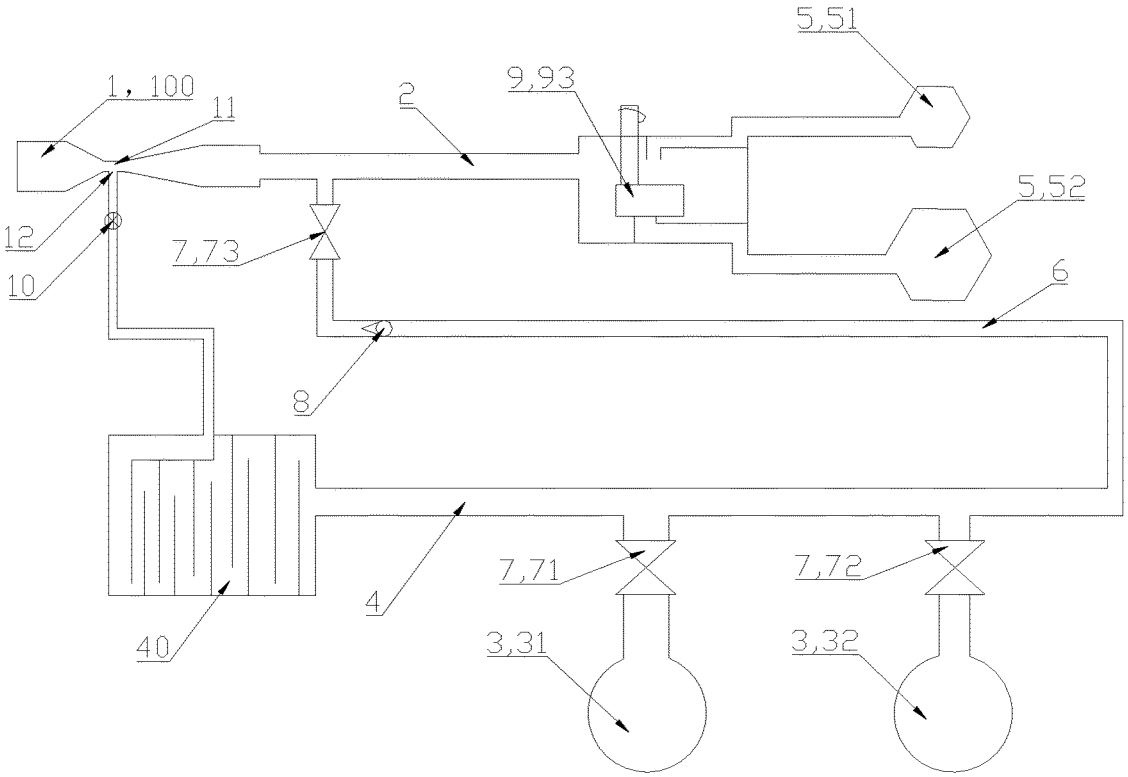

As shown in FIG. 2, different from the above-mentioned embodiment, the present embodiment lies in that: the water outlet end of the connecting pipeline 4 communicates with the pumping port 12 of the venturi tube 100, the water inlet end of the connecting pipeline 4 communicates with one end of the flushing pipeline 6, and the other end of the flushing pipeline 6 communicates with the water supply pipeline 2; and the connecting pipeline 4 is sequentially provided with a plurality of ports, each of the ports communicates with each of the liquid storage parts 3 on the automatic feeding device in a one-to-one correspondence way, and each connection part is provided with a control valve 7 for controlling on/off. The flushing pipeline 6 is provided with a control valve 7 for controlling the on/off of the pipeline so that a flushing water flow for flushing the connecting pipeline 4 in the water supply pipeline 2 is switched to be controlled to flow in the flushing pipeline 6 or not.

Preferably, in order to avoid the situation that the water flow in the flushing pipeline 6 flows back to the water supply pipeline 2, an arrangement may be made as follows: the flushing pipeline 6 is provided with a one-way valve 8, and the one-way valve 8 controls the flow direction of the liquid in the pipeline so as to ensure that the liquid in the flushing pipeline 6 may only flow to the connecting pipeline 4 along the water supply pipeline 2.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 2, in the present embodiment, one end of the connecting pipeline 4 communicates with the pumping port 12 of the venturi tube 100, and the other end of the connecting pipeline 4 communicates with the water outlet end of the flushing pipeline 6; the connecting pipeline 4 is sequentially provided with two ports, one of the ports communicates with the first liquid storage part 31 by a first control valve 71, and the other port communicates with the second liquid storage part 32 by a second control valve 72; and the flushing pipeline 6 is provided with a third control valve 73 for controlling the on/off of the pipeline.

When an additive in the first liquid storage part 31 is fed, the automatic feeding device is in the following state:

the first control valve 71 is opened, the second control valve 72 is closed, and the third control valve 73 is closed; at the moment, the first liquid storage part 31 communicates with the pumping port 12 of the venturi tube 100 by the connecting pipeline 4, the additive in the first liquid storage part 31 is pumped into the water supply pipeline 2 with the inlet water flow and flows into the corresponding water tub 5 with the water flow in the water supply pipeline 2.

When an additive in the second liquid storage part 32 is fed, the automatic feeding device is in the following state:

the first control valve 71 is closed, the second control valve 72 is opened, and the third control valve 73 is closed; at the moment, the second liquid storage part 32 communicates with the pumping port 12 of the venturi tube 100 by the connecting pipeline 4, the additive in the second liquid storage part 32 is pumped into the water supply pipeline 2 with the inlet water flow and flows into the corresponding water tub 5 with the water flow in the water supply pipeline 2.

When the pumping structure 1 is flushed, the automatic feeding device is in the following state:

the first control valve 71 is closed, the second control valve 72 is closed, and the third control valve 73 is opened; at the moment, the connecting pipeline 4 communicates with the water supply pipeline 2 by the flushing pipeline 6, the inlet water flow in the water supply pipeline 2 directly flows into the connecting pipeline 4 through the flushing pipeline 6, returns to the water supply pipeline 2 by the pumping port 12 of the venturi tube 100 after flushing the connecting pipeline 4, and then flows from the water outlet end of the water supply pipeline 2 to the corresponding water tub 5, so that the aim that the residual additives in the connecting pipeline 4 and the venturi tube 100 are flushed is achieved.

Embodiment 4

Figure 3:
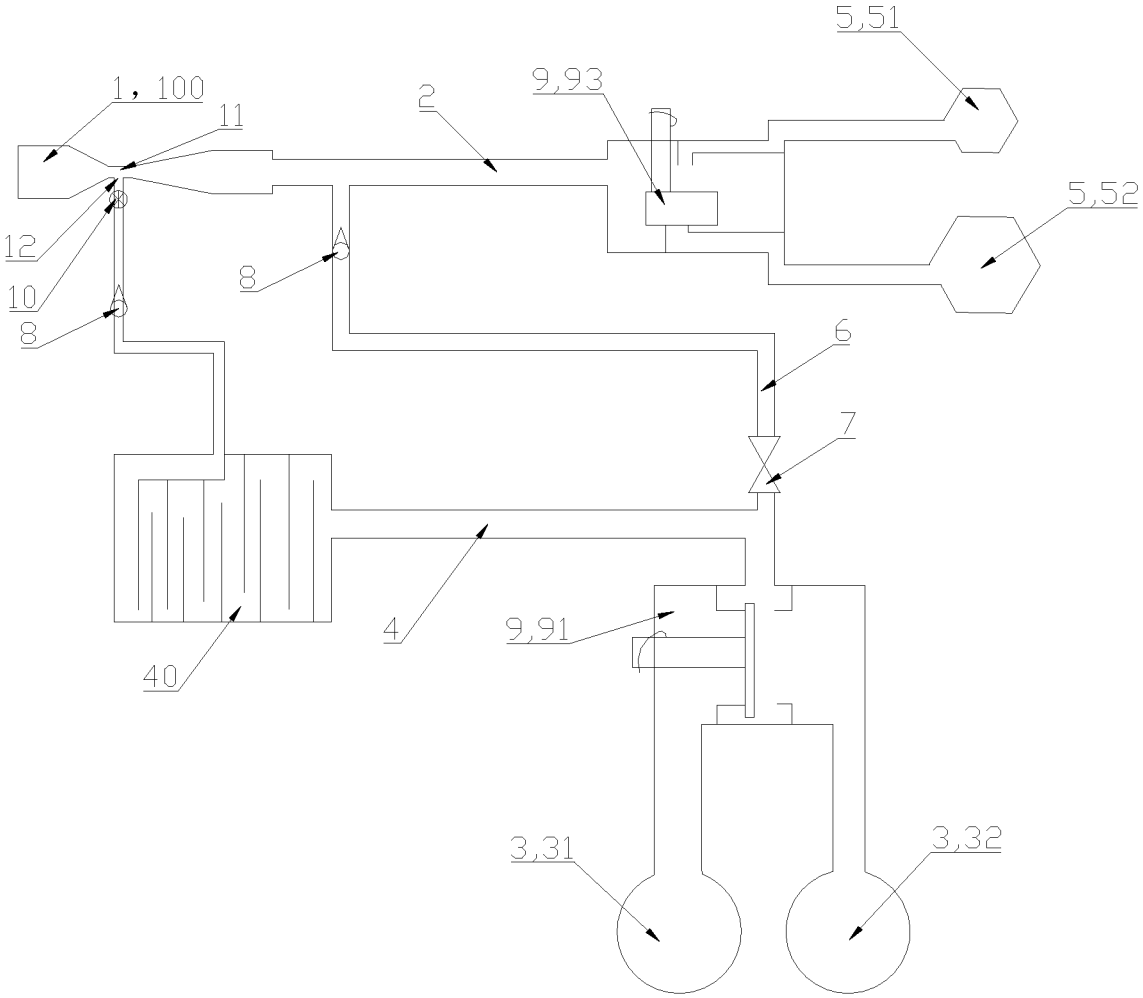

As shown in FIG. 3, different from the above-mentioned embodiment, the present embodiment lies in that: the water outlet end of the connecting pipeline 4 communicates with the pumping port 12 of the venturi tube 100, the water inlet end of the connecting pipeline 4 communicates with one end of the flushing pipeline 6, and the other end of the flushing pipeline 6 communicates with the water supply pipeline 2; and the connecting pipeline 4 is provided with a port, the port communicates with each of the liquid storage parts 3 on the automatic feeding device in a one-to-one correspondence way by a reversing valve 9; and the reversing valve 9 is a first reversing valve 91 provided with one outlet and a plurality of inlets, each of the inlets of the first reversing valve 91 is connected with each of the liquid storage parts 3 in a one-to-one correspondence way, and the outlet of the first reversing valve 91 is connected to the connecting pipeline 4 by the port.

Preferably, in order to ensure that there is no interference from flushing water flowing into the flushing pipeline 6 when the additives are fed in the water supply pipeline 2 by the automatic feeding device, the flushing pipeline 6 is provided with a control valve 7 for controlling the on/off of the pipeline, and the control valve 7 is arranged at the side, close to the water outlet end, of the flushing pipeline 6.

Meanwhile, in order to avoid the situation that the water flow in the flushing pipeline 6 flows back to the water supply pipeline 2, the flushing pipeline 6 is provided with a one-way valve 8 for ensuring that water in the pipeline flows in a single direction, and the one-way valve 8 is arranged at the side, close to the water inlet end, of the flushing pipeline 6.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 3, in the present embodiment, one end of the connecting pipeline 4 communicates with the pumping port 12 of the venturi tube 100, and the other end of the connecting pipeline 4 communicates with the water outlet end of the flushing pipeline 6; the connecting pipeline 4 is provided with a port, the port communicates with the outlet of the first reversing valve 91, the first inlet of the first reversing valve 91 communicates with the first liquid storage part 31, and the second inlet of the first reversing valve 91 communicates with the second liquid storage part 32; and the flushing pipeline 6 is provided with a control valve 7 for controlling the on/off of the pipeline.

When an additive in the first liquid storage part 31 is fed, the automatic feeding device is in the following state:

the outlet of the first reversing valve 91 communicates with the first inlet and is disconnected with the second inlet, and the control valve 7 is closed; at the moment, the first liquid storage part 31 communicates with the pumping port 12 of the venturi tube 100 by the connecting pipeline 4, the additive in the first liquid storage part 31 is pumped into the water supply pipeline 2 with the inlet water flow and flows into the corresponding water tub 5 with the water flow in the water supply pipeline 2.

When an additive in the second liquid storage part 32 is fed, the automatic feeding device is in the following state:

the outlet of the first reversing valve 91 communicates with the second inlet and is disconnected with the first inlet, and the control valve 7 is closed; at the moment, the second liquid storage part 32 communicates with the pumping port 12 of the venturi tube 100 by the connecting pipeline 4, the additive in the second liquid storage part 32 is pumped into the water supply pipeline 2 with the inlet water flow and flows into the corresponding water tub 5 with the water flow in the water supply pipeline 2.

When the pumping structure 1 is flushed, the automatic feeding device is in the following state:

the outlet of the first reversing valve 91 is disconnected with the first inlet and the second inlet, and the control valve 7 is opened; at the moment, the connecting pipeline 4 communicates with the water supply pipeline 2 by the flushing pipeline 6, the inlet water flow in the water supply pipeline 2 directly flows into the connecting pipeline 4 through the flushing pipeline 6, returns to the water supply pipeline 2 by the pumping port 12 of the venturi tube 100 after flushing the connecting pipeline 4, and then flows from the water outlet end of the water supply pipeline 2 to the corresponding water tub 5, so that the aim that the residual additives in the connecting pipeline 4 and the venturi tube 100 are flushed is achieved.

Embodiment 5

Figure 4:
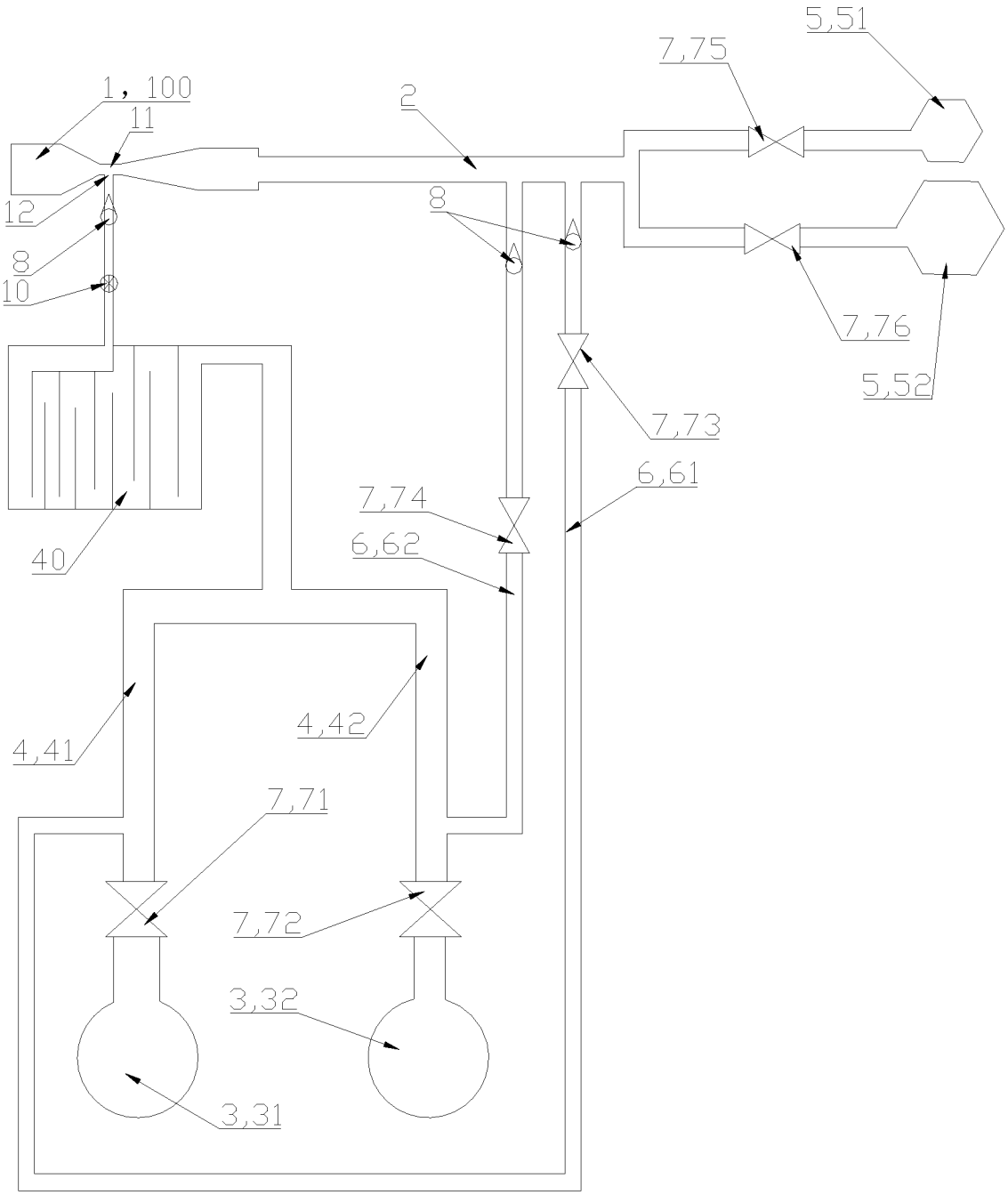

As shown in FIG. 4, different from the above-mentioned embodiment, the present embodiment lies in that: the pumping port 12 of the venturi tube 100 communicates with the water outlet ends of a plurality of connecting pipelines 4, a water inlet end of each of the connecting pipelines 4 communicates with each of the liquid storage parts 3 of the automatic feeding device in a one-to-one correspondence way, and each of the connecting pipelines 4 is provided with a control valve 7 for controlling the on/off of the pipelines.

In the present embodiment, each of the connecting pipelines 4 is provided with a port, and each of the ports communicates with the water supply pipeline 2 by a corresponding flushing pipeline 6; and the water inlet end of each of the flushing pipelines 6 communicates with a part, located between the pumping port 12 of the venturi tube and the water outlet end, of the water supply pipeline 2. Each of the flushing pipelines 6 is provided with a control valve 7 for controlling the on/off of the pipelines. Preferably, in order to guarantee the single flow direction of the water flow in each of the flushing pipelines 6 and avoid a backflow situation, the water inlet end of each of the flushing pipelines 6 is provided with a one-way valve 8.

Meanwhile, in order to ensure that a flushing water flow does not flow into the liquid storage parts 3 along the connecting pipelines 4, the control valve 7 arranged on each of the connecting pipelines 4 is arranged at the upstream of a port connected with the corresponding flushing pipeline 6.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 4, in the present embodiment, water outlet ends of both a first connecting pipeline 41 and a second connecting pipeline 42 communicate with the pumping port 12 of the venturi tube 100, and the other ends of the first connecting pipeline 41 and the second connecting pipeline 42 respectively communicate with the first liquid storage part 31 and the second liquid storage part 32. A junction of the first connecting pipeline 41 and the first liquid storage part 31 is provided with a first control valve 71 for controlling on/off, and a junction of the second connecting pipeline 42 and the second liquid storage part 32 is provided with a second control valve 72 for controlling on/off.

In the present embodiment, each of the first connecting pipeline 41 and the second connecting pipeline 42 is provided with a port, the port formed in the first connecting pipeline 41 communicates with the water supply pipeline 2 by a first flushing pipeline 61, and the port formed in the second connecting pipeline 42 communicates with the water supply pipeline 2 by a second flushing pipeline 62; and the first flushing pipeline 61 is provided with a third control valve 73 for controlling the on/off of the pipeline, and the second flushing pipeline 62 is provided with a fourth control valve 74 for controlling the on/off of the pipeline.

When an additive in the first liquid storage part 31 is fed, the automatic feeding device is in the following state:

the first control valve 71 is opened, the second control valve 72 is closed, the third control valve 73 is closed, and the fourth control valve 74 is closed; at the moment, the first liquid storage part 31 communicates with the pumping port 12 of the venturi tube 100 by the first connecting pipeline 41, the additive in the first liquid storage part 31 is pumped into the water supply pipeline 2 with the inlet water flow and flows into the corresponding water tub 5 with the water flow in the water supply pipeline 2.

When an additive in the second liquid storage part 32 is fed, the automatic feeding device is in the following state:

the first control valve 71 is closed, the second control valve 72 is opened, the third control valve 73 is closed, and the fourth control valve 74 is closed; at the moment, the second liquid storage part 32 communicates with the pumping port 12 of the venturi tube 100 by the second connecting pipeline 42, the additive in the second liquid storage part 32 is pumped into the water supply pipeline 2 with the inlet water flow and flows into the corresponding water tub 5 with the water flow in the water supply pipeline 2.

When the pumping structure 1 and the first connecting pipeline 41 are flushed, the automatic feeding device is in the following state:

the first control valve 71 is closed, the second control valve 72 is closed, the third control valve 73 is opened, and the fourth control valve 74 is closed; at the moment, the first connecting pipeline 41 communicates with the water supply pipeline 2 by the first flushing pipeline 61, the inlet water flow in the water supply pipeline 2 directly flows into the first connecting pipeline 41 through the first flushing pipeline 61, returns to the water supply pipeline 2 by the pumping port 12 of the venturi tube 100 after flushing the first connecting pipeline 41, and then flows from the water outlet end of the water supply pipeline 2 to the corresponding water tub 5, so that the aim that the residual additives in the first connecting pipeline 41 and the venturi tube 100 are flushed is achieved.

When the pumping structure 1 and the second connecting pipeline 42 are flushed, the automatic feeding device is in the following state:

the first control valve 71 is closed, the second control valve 72 is closed, the third control valve 73 is closed, and the fourth control valve 74 is opened; at the moment, the second connecting pipeline 42 communicates with the water supply pipeline 2 by the second flushing pipeline 62, the inlet water flow in the water supply pipeline 2 directly flows into the second connecting pipeline 42 through the second flushing pipeline 62, returns to the water supply pipeline 2 by the pumping port 12 of the venturi tube 100 after flushing the second connecting pipeline 42, and then flows from the water outlet end of the water supply pipeline 2 to the corresponding water tub 5, so that the aim that the residual additives in the second connecting pipeline 42 and the venturi tube 100 are flushed is achieved.

Embodiment 6

As shown in FIG. 4, different from the above-mentioned embodiment, the present embodiment lies in that: the water outlet end of the water supply pipeline 2 is connected with the water tubs 5 in a one-to-one correspondence way by a plurality of pipelines, and each of the pipelines is provided with a control valve 7 for controlling on/off, so that the automatic feeding device is connected with one of the water tubs 5 by each of the pipelines which may be controlled to be connected/disconnected, and furthermore, the aim that the water tubs of the drum washing machine are respectively and correspondingly supplied with water is achieved.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 4, the water outlet end of the water supply pipeline 2 communicates with one end of each of two pipelines, and the other ends of the two pipelines respectively communicate with the first water tub 51 and the second water tub 52; and the two pipelines are respectively provided with a fifth control valve 75 and a sixth control valve 76 for controlling the on/off of the corresponding pipelines.

When the first water tub 51 is supplied with water and is fed with an additive, the fifth control valve 75 is opened, the sixth control valve 76 is closed, the water flow in the water supply pipeline 2 flows into the first water tub 51 by the pipeline on which the fifth control valve 75 is in an open state.

When the second water tub 52 is supplied with water and is fed with an additive, the fifth control valve 75 is closed, the sixth control valve 76 is opened, the water flow in the water supply pipeline 2 flows into the second water tub 52 by the pipeline on which the sixth control valve 76 is in an open state.

Embodiment 7

The present embodiment introduces a control method applied to the automatic feeding device according to any one of the above-mentioned embodiments 1-6. When the additives are fed, a water flow at a water supply source flows to one of the water tubs by the water supply pipeline, the additives in the liquid storage parts are pumped out by virtue of a negative pressure generated when the water flow flows through the pumping structure, enter the water supply pipeline from the pumping port, and are then flushed into the corresponding water tub with the water flow in the water supply pipeline.

In the present embodiment, when the pumping structure is flushed, the water supply pipeline communicates with the flushing pipeline, the liquid storage parts are disconnected with the pumping structure, and the water flow in the water supply pipeline flows to the pumping structure by the flushing pipeline, and then returns to the water supply pipeline by the pumping port of the pumping structure; and preferably, when the pumping structure is flushed, the water outlet end of the water supply pipeline communicates with the flushing pipeline and one of the water outlets, a part of the water flow in the water supply pipeline flows to one of the water outlets, the other part of the water flow flows to the flushing pipeline, and after the pumping structure is flushed by the flushing pipeline, flushing water returning from the pumping port to the flushing pipeline may flow out of one of the water outlets.

In the present embodiment, the different types of additives stored in the plurality of liquid storage parts may be respectively fed by the automatic feeding device. When the additives are fed by the automatic feeding device, the pumping port communicates with one of the plurality of liquid storage parts, so that the corresponding liquid storage part communicates with the water supply pipeline, and the additives stored in the corresponding liquid storage parts are pumped into the water supply pipeline and are flushed into the corresponding water tubs with the inlet water flow.

A multi-drum washing machine provided with two water tubs respectively being a first water tub and a second water tub and two liquid storage parts respectively being a first liquid storage part and a second liquid storage part is taken as an example to be described below, and the specific control method is described as follows:

when an additive A stored in the first liquid storage part is fed into the first water tub, the water supply pipeline of the automatic feeding device supplies washing water to the first water tub, during water supply, an outlet of the first liquid storage part is interruptedly opened, when the outlet of the first liquid storage part is opened, the additive A stored in the first liquid storage part is pumped into the water supply pipeline by the pumping structure by virtue of the connecting pipeline and is flushed into the first water tub with the inlet water flow; and within the time period when the outlet of the first liquid storage part is closed, a part of the water flow in the water supply pipeline flows into the pumping structure through the flushing pipeline to flush the residual additive A in the pumping structure and the connecting pipeline, so that the additive A which is pumped and fed once is totally flushed into the first water tub with a flushing water flow.

When the additive A stored in the first liquid storage part is fed into the second water tub, the water supply pipeline of the automatic feeding device supplies washing water to the second water tub, during water supply, the outlet of the first liquid storage part is interruptedly opened, when the outlet of the first liquid storage part is opened, the additive A stored in the first liquid storage part is pumped into the water supply pipeline by the pumping structure by virtue of the connecting pipeline and is flushed into the second water tub with the inlet water flow; and within the time period when the outlet of the first liquid storage part is closed, a part of the water flow in the water supply pipeline flows into the pumping structure through the flushing pipeline to flush the residual additive A in the pumping structure and the connecting pipeline, so that the additive A which is pumped and fed once is totally flushed into the second water tub with a flushing water flow.

When an additive B stored in the second liquid storage part is fed into the first water tub, the water supply pipeline of the automatic feeding device supplies washing water to the first water tub, during water supply, an outlet of the second liquid storage part is interruptedly opened, when the outlet of the second liquid storage part is opened, the additive B stored in the second liquid storage part is pumped into the water supply pipeline by the pumping structure by virtue of the connecting pipeline and is flushed into the first water tub with the inlet water flow; and within the time period when the outlet of the second liquid storage part is closed, a part of the water flow in the water supply pipeline flows into the pumping structure through the flushing pipeline to flush the residual additive B in the pumping structure and the connecting pipeline, so that the additive B which is pumped and fed once is totally flushed into the first water tub with a flushing water flow.

When the additive B stored in the second liquid storage part is fed into the second water tub, the water supply pipeline of the automatic feeding device supplies washing water to the second water tub, during water supply, the outlet of the second liquid storage part is interruptedly opened, when the outlet of the second liquid storage part is opened, the additive B stored in the second liquid storage part is pumped into the water supply pipeline by the pumping structure by virtue of the connecting pipeline and is flushed into the second water tub with the inlet water flow; and within the time period when the outlet of the second liquid storage part is closed, a part of the water flow in the water supply pipeline flows into the pumping structure through the flushing pipeline to flush the residual additive B in the pumping structure and the connecting pipeline, so that the additive B which is pumped and fed once is totally flushed into the second water tub with a flushing water flow.

Embodiment 8

As shown in FIG. 5 to FIG. 8, the present embodiment introduces a multi-drum washing machine, including a plurality of water tubs 5 arranged to be independent from each other, wherein each of the water tubs 5 is capable of respectively treating clothes; the washing machine is provided with a water inlet structure for introducing an external water flow to the inside of the washing machine; and the washing machine is further provided with an automatic feeding device for feeding additives into the corresponding water tubs 5 with an inlet water flow flowing with the water inlet structure so as to treat the clothes in the corresponding water tubs 5 by using the additives fed with the inlet water flow.

In the present embodiment, the additives include, but are not limited to the following additives: a detergent, a softener, a disinfectant, a flavoring agent and a bleaching agent.

As shown in FIG. 5 to FIG. 8, the present embodiment further introduces an automatic feeding device which may be applied to the above-mentioned multi-drum washing machine and used for feeding the additives to the corresponding water tubs 5 of the washing machine; and the automatic feeding device may also be applied to any existing equipment so as to feed the corresponding additives into any waterway channel in the equipment.

The automatic feeding device in the present embodiment includes: liquid storage parts 3, containing additives used when clothes are treated; and at least two water supply pipelines 2, wherein a water inlet end of each of the water supply pipelines 2 communicates with the same water supply source, and the water supply pipelines 2 are respectively provided with different water outlets in one-to-one correspondence to the water supply pipelines 2 so that inlet water is delivered to the water outlet of the corresponding pipeline by each of the water supply pipelines 2. Each of the water supply pipelines 2 is provided with a pumping structure 1 capable of generating a negative pressure by virtue of a water flow flowing through the corresponding water supply pipeline to pump and deliver the additives in the liquid storage parts 3 to the water supply pipeline 2 and enable the additives to flow to the corresponding water outlet with the water flow. In the present embodiment, when the automatic feeding device is mounted on a multi-drum washing machine, the water outlet of each of the water supply pipelines 2 of the automatic feeding device communicates with each of the water tubs 5 of the washing machine in a one-to-one correspondence way, a water supply source is supplied by the water inlet structure of the washing machine, so that the additives are fed into the corresponding water tubs 5 together with the inlet water flow in a process that washing water enters the corresponding water tubs 5 of the multi-drum washing machine. Of course, for meeting the design demand of the washing machine, the number of the water outlets of the automatic feeding device may also be set to be different from that of the water tubs to ensure that at least one of the water tubs corresponds to a plurality of the water outlets, or at least one of the water outlets corresponds to a plurality of the water tubs.

Due to the above-mentioned arrangement, the additives may be fed to the corresponding water outlets by the automatic feeding device by virtue of different pumping structures, so that the aim that the additives are respectively fed to a plurality of positions by using a set of system is achieved. Meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved.

The automatic feeding device in the present embodiment further includes a flushing pipeline 6; water flows at water outlet ends of the water supply pipelines 2 are directly introduced to the pumping structures 1 by the flushing pipeline 6, and then circularly return to the water supply pipelines 2 through the pumping structures 1, and the pumping structures 1 are flushed by using circulating water, so that residual additives in the pipelines are flushed by using flushing water after the additives are fed once by the automatic feeding device, and furthermore, it is ensured that the additives fed when the automatic feeding device is started every time are all discharged into the water supply pipelines with the water flows; and meanwhile, the aim of flushing the automatic feeding device to prevent the residual additives from affecting the subsequence use of the device is achieved. Preferably, the flushing pipeline 6 may be provided with a one-way valve 8 for ensuring the water flow in the pipeline flows from a water inlet end to the water outlet end in a single direction; and preferably, the flushing pipeline 6 may be provided with a control valve 7 for controlling the water flow to flow in the pipeline or not.

The automatic feeding device in the present embodiment includes at least two liquid storage parts 3, wherein different types of additives may be respectively stored in the liquid storage parts 3. Each of the liquid storage parts 3 communicates with a pumping port of each of the pumping structures 1 by a different connecting pipeline 4, and each of the connecting pipelines 4 is provided with a control valve 7 for controlling the on/off of the pipeline; or, each of the at least two liquid storage parts 3 is connected with the same connecting pipeline 4 by a pipeline provided with a control valve 7; or, the at least two liquid storage parts 3 are connected with the same connecting pipeline 4 by reversing valves 9, and each of the liquid storage parts 3 is enabled to communicate with one of the connecting pipelines 4 under the action of the reversing valves 9; or, the pumping port of each of the at least two pumping structures 1 is connected with the same connecting pipeline 4 by a pipeline provided with a control valve 7; or the connecting pipelines 4 are connected with the pumping ports of the at least two pumping structures 1 by the reversing valves 9, and the connecting pipelines 4 are enabled to communicate with the pumping port of one of the pumping structures 1 under the action of the reversing valves 9.

Embodiment 9

Figure 5:
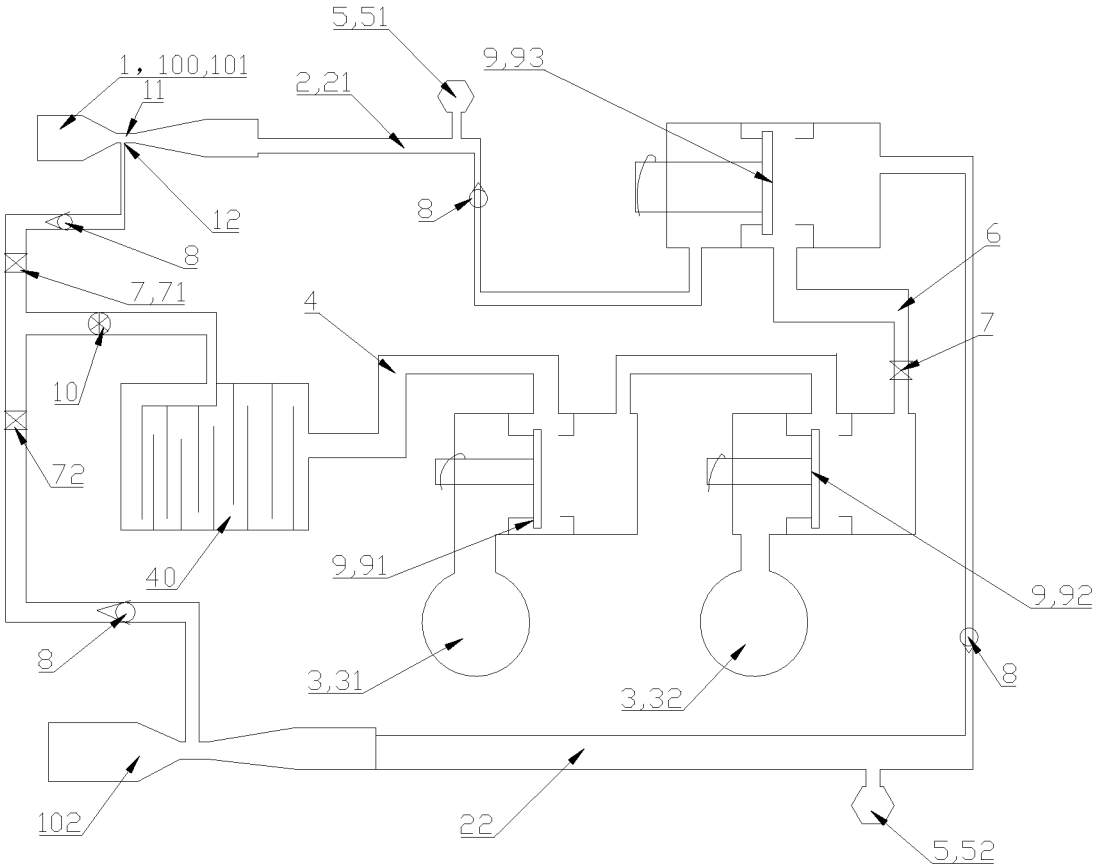

As shown in FIG. 5, the present embodiment introduces an automatic feeding device, including liquid storage parts 3, containing additives used when clothes are treated; and at least two water supply pipelines 2, wherein a water inlet end of each of the water supply pipelines 2 communicates with a water inlet structure of a multi-drum washing machine, a water outlet end of each of the water supply pipelines 2 communicates with a different water tub 5 in one-to-one correspondence to the water outlet end to enable inlet water of the washing machine to be respectively delivered to the corresponding water tub 5 by each of the water supply pipelines 2, so that the aim that washing water enters any one of the water tubs 5 of the multi-drum washing machine is achieved. Each of the water supply pipelines 2 is provided with a pumping structure 1 capable of generating a negative pressure by virtue of an inlet water flow flowing through the corresponding water supply pipeline 2 to pump and deliver the additives in the liquid storage parts 3 to the water supply pipeline 2 and enable the additives to be fed into the corresponding water tub 5 of the washing machine with the inlet water flow. In the embodiment of the present disclosure, when the automatic feeding device is mounted on the multi-drum washing machine, each of water outlets of the automatic feeding device communicates with each of the water tubs 5 of the washing machine in a one-to-one correspondence way, a water supply source is supplied by the water inlet structure of the washing machine, so that the additives are fed into the corresponding water tubs 5 together with the inlet water flows in a process that washing water enters the corresponding water tubs 5 of the multi-drum washing machine, and furthermore, the aim that the additives are automatically fed into the corresponding water tubs 5 with the inlet water flows is achieved.

In the present embodiment, each of the pumping structures 1 includes a venturi tube 100 arranged in each of the water supply pipelines 2 and capable of generating a negative pressure by virtue of the flowing of the water flow, and a negative pressure region 11 is provided with a pumping port 12 communicating with the liquid storage parts 3 and used for pumping the additives into the water flow of each of the water supply pipelines by virtue of the negative pressure. In the present embodiment, two ends of the venturi tube 100 are both connected into each of the water supply pipelines 2 and respectively and correspondingly communicate with the water inlet end and the water outlet end; and the middle of the venturi tube 100 is provided with a necking part of which the inner tube diameter is suddenly reduced. Since the tube wall inner diameter of the necking part is suddenly reduced, the flow rate of the water flow in the region is suddenly increased so that the necking part forms a negative pressure region 11 where a negative pressure is generated with the flowing of the water flow, the negative pressure region 11 is provided with a port communicating with the outside, and the port forms the pumping port 12, communicating with the liquid storage parts 3 by a connecting pipeline 4, of the pumping structure 1. Due to the above-mentioned arrangement, the pumping structure is enabled to be directly composed of the venturi tube generating a negative pressure pumping effect with the change of the flow rate of the water flow, so that the aim that the additives stored in the liquid storage parts are pumped into the inlet water flow with the inlet water flow is achieved.

In the present embodiment, the water outlet end of each of the water supply pipelines 2 communicates with a different water tub 5 in one-to-one correspondence to the water outlet end. Preferably, the water supply pipelines 2 are provided with one-way valves 8 for ensuring the water flows in the pipelines flow from water inlet source ends to the water outlet ends in a single direction. Therefore, by using the automatic feeding device, the aim that the different water tubs are respectively supplied with water and fed with the additives is achieved due to water supply from different water supply flow channels.

In the present embodiment, the automatic feeding device further includes a flushing pipeline 6; a water inlet end of the flushing pipeline 6 communicates with parts, located at the downstream of the venturi tube 100 and the upstream of a third reversing valve 93, of the water supply pipelines 2, the water outlet end of the flushing pipeline 6 communicates with one end of the connecting pipeline 4, and the other end of the connecting pipeline 4 communicates with the pumping ports of the pumping structures 1. Due to the above-mentioned arrangement, water flows at water outlet ends of the water supply pipelines 2 are directly introduced to the pumping structures 1, and then circularly return to the water supply pipelines 2 by virtue of the pumping structures, and the pumping structures 1 are flushed by using circulating water, so that the residual additives in the pipelines are flushed by using flushing water after the additives are fed once by the automatic feeding device, and furthermore, it is ensured that the additives fed when the automatic feeding device is started every time are all discharged into the water supply pipelines with the water flows; and meanwhile, the aim of flushing the automatic feeding device to prevent the residual additives from affecting the subsequence use of the device is achieved. Preferably, the flushing pipeline 6 may be provided with a one-way valve 8 for ensuring the water flow in the pipeline flows from a water inlet end to the water outlet end in a single direction; and preferably, the flushing pipeline 6 may be provided with a control valve 7 for controlling the water flow to flow in the pipeline or not.

In the present embodiment, the automatic feeding device includes at least two liquid storage parts 3, wherein the liquid storage parts 3 are respectively fed with different types of additives, so that the aim that the different types of additives are automatically fed by classification by the automatic feeding device is achieved.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 5, in the present embodiment, a water inlet end of a first water supply pipeline 21 is provided with a first venturi tube 101, and a water outlet end of the first water supply pipeline 21 communicates with the first water tub 51. A water inlet end of a second water supply pipeline 22 is provided with a second venturi tube 102, and a water outlet end of the second water supply pipeline 22 communicates with the second water tub 52. The water outlet end of each of the first water supply pipeline 21 and the second water supply pipeline 22 is provided with a port, and the two ports communicate with an inlet of the same flushing pipeline by a reversing valve 9; and the reversing valve 9 is a third reversing valve 93 which is provided with two inlets and one outlet, wherein the two inlets respectively communicate with the ports of the first water supply pipeline 21 and the second water supply pipeline 22, and the outlet communicates with a water inlet end of the flushing pipeline 6.

In the present embodiment, a water outlet end of the connecting pipeline 4 respectively communicates with a pumping port 12 of the first venturi tube 101 by a pipeline provided with a first control valve 71 and a pumping port of the second venturi tube 102 by a pipeline provided with a second control valve 72. Preferably, in order to avoid the situation that the water flows in the water supply pipelines 2 flow from the pumping ports 12 back to the connecting pipeline 4, an arrangement may be made as follows: each of a pipeline located between a labyrinth loop 40 and the pumping port of the first venturi tube 101 and a pipeline located between the labyrinth loop 40 and the pumping port of the second venturi tube 102 is provided with a one-way valve 8, and the one-way valves 8 control flow directions of liquids in the pipelines so as to ensure that the liquids in the pipelines always flow to one side of each of the venturi tubes 100 in a single direction.

In the present embodiment, the water inlet end of the connecting pipeline 4 communicates with the water outlet end of the flushing pipeline 6; and preferably, a connection part may be provided with a control valve 7 for controlling on/off, so that the aim that the automatic feeding device is switched to feed the additives and flush the pipelines is achieved.

When an additive A in the first liquid storage part 31 is fed into the first water tub 51, the automatic feeding device is in the following state:

an outlet of a first reversing valve 91 communicates with a second inlet and is disconnected with a first inlet, the first control valve 71 is opened, the second control valve 72 is closed, and the second inlet of the third reversing valve 93 communicates with the outlet, at the moment, the first liquid storage part 31 communicates with the pumping port 12 of the first venturi tube 101 by the connecting pipeline 4, the additive A in the first liquid storage part 31 is pumped into the first water supply pipeline 21 with the inlet water flow and flows into the first water tub 51 with the water flow in the first water supply pipeline 21.

When an additive B in the second liquid storage part 32 is fed into the first water tub 51, the automatic feeding device is in the following state:

the outlet of the first reversing valve 91 communicates with the first inlet and is disconnected with the second inlet, an outlet of a second reversing valve 92 communicates with a second inlet and is disconnected with a first inlet, the first control valve 71 is opened, the second control valve 72 is closed, and the second inlet of the third reversing valve 93 communicates with the outlet, at the moment, the second liquid storage part 32 communicates with the pumping port of the first venturi tube 101 by the connecting pipeline 4, the additive B in the second liquid storage part 32 is pumped into the first water supply pipeline 21 with the inlet water flow and flows into the corresponding first water tub 51 with the water flow in the first water supply pipeline 21.

When the additive A in the first liquid storage part 31 is fed into the second water tub 52, the automatic feeding device is in the following state:

the outlet of the first reversing valve 91 communicates with the second inlet and is disconnected with the first inlet, the first control valve 71 is closed, the second control valve 72 is opened, and the first inlet of the third reversing valve 93 communicates with the outlet, at the moment, the first liquid storage part 31 communicates with the pumping port 12 of the second venturi tube 102 by the connecting pipeline 4, the additive A in the first liquid storage part 31 is pumped into the second water supply pipeline 22 with the inlet water flow and flows into the second water tub 52 with the water flow in the second water supply pipeline 22.

When the additive B in the second liquid storage part 32 is fed into the second water tub, the automatic feeding device is in the following state:

the outlet of the first reversing valve 91 communicates with the first inlet and is disconnected with the second inlet, the outlet of the second reversing valve 92 communicates with the second inlet and is disconnected with the first inlet, the first control valve 71 is closed, the second control valve 72 is opened, and the first inlet of the third reversing valve 93 communicates with the outlet, at the moment, the second liquid storage part 32 communicates with the pumping port of the second venturi tube 102 by the connecting pipeline 4, the additive B in the second liquid storage part 32 is pumped into the second water supply pipeline 22 with the inlet water flow and flows into the corresponding second water tub 52 with the water flow in the second water supply pipeline 22.

When the pumping structure 1 arranged on the first water supply pipeline 21 is flushed, the automatic feeding device is in the following state:

the outlet of the first reversing valve 91 communicates with the first inlet and is disconnected with the second inlet, the outlet of the second reversing valve 92 communicates with the first inlet and is disconnected with the second inlet, the first control valve 71 is opened, the second control valve 72 is closed, and the first inlet of the third reversing valve 93 communicates with the outlet, at the moment, the connecting pipeline 4 communicates with the flushing pipeline 6, the inlet water flow in the first water supply pipeline 21 directly flows into the connecting pipeline 4 through the flushing pipeline 6, returns to the first water supply pipeline 21 by the pumping port of the first venturi tube 101 after flushing the connecting pipeline 4, and then flows from the water outlet end of the first water supply pipeline 21 to the corresponding first water tub 51, so that the aim that the residual additives in the connecting pipeline 4 and the first venturi tube 101 are flushed is achieved.

When the pumping structure 1 arranged on the second water supply pipeline 22 is flushed, the automatic feeding device is in the following state:

the outlet of the first reversing valve 91 communicates with the first inlet and is disconnected with the second inlet, the outlet of the second reversing valve 92 communicates with the first inlet and is disconnected with the second inlet, the second control valve 72 is opened, the first control valve 71 is closed, and the second inlet of the third reversing valve 93 communicates with the outlet, at the moment, the connecting pipeline 4 communicates with the flushing pipeline 6, the inlet water flow in the second water supply pipeline 22 directly flows into the connecting pipeline 4 through the flushing pipeline 6, returns to the second water supply pipeline 22 by the pumping port 12 of the second venturi tube 102 after flushing the connecting pipeline 4, and then flows from the water outlet end of the second water supply pipeline 22 to the corresponding second water tub 52, so that the aim that the residual additives in the connecting pipeline 4 and the second venturi tube 102 are flushed is achieved.

In the present embodiment, in order to increase the feeding amount of the additives fed once by the automatic feeding device, the connecting pipeline 4 is provided with a labyrinth loop 40; and the labyrinth loop 40 is composed of a flow channel arranged to be swirled and capable of extending the axial length of the pipeline, and two ends of the flow channel respectively communicate with the liquid storage parts 3 and the pumping ports 12 of the pumping structures 1.

In the present embodiment, in order to realize metering detection of the feeding amount of the additives, an arrangement may be made as follows: the connecting pipeline 4 located between the labyrinth loop 40 and the pumping port 12 of each of the pumping structures is provided with a metering device 10 for detecting the flow of a flowing liquid.

Embodiment 10

Figure 6:
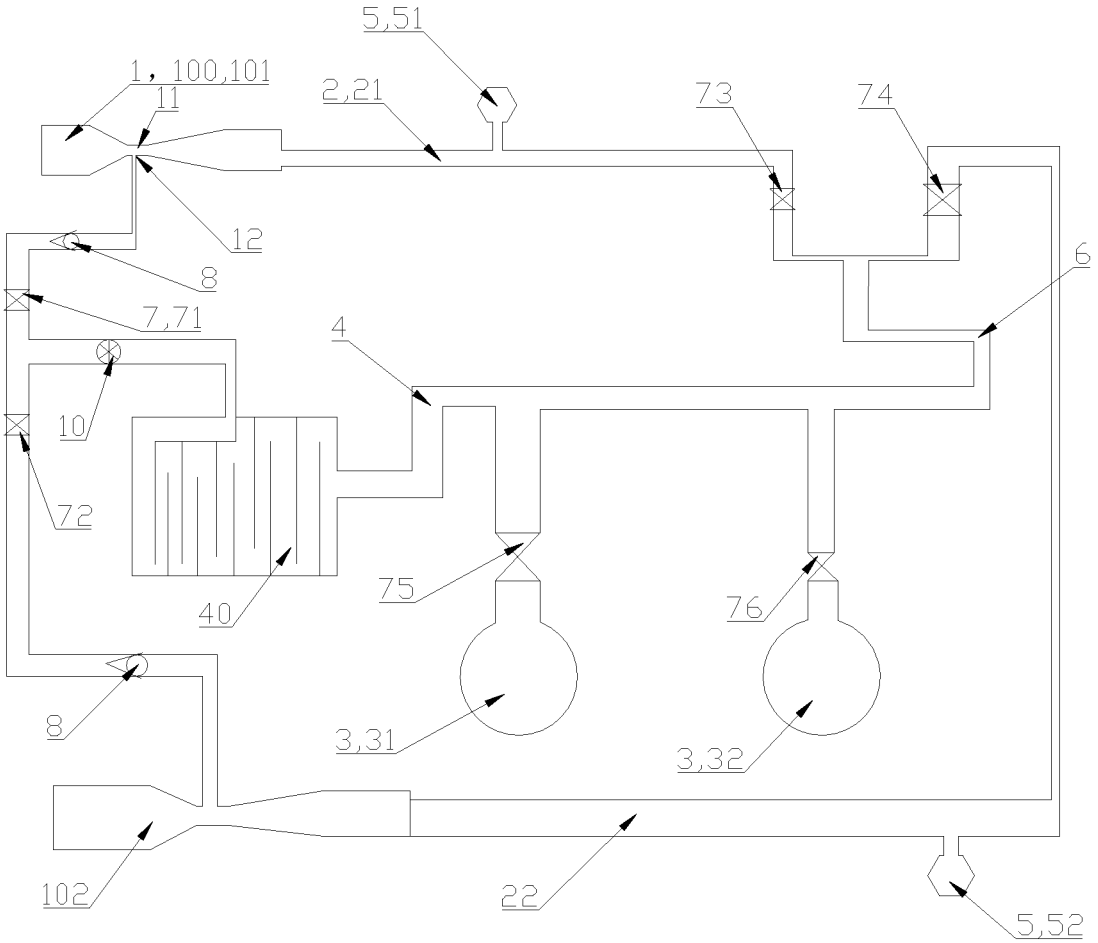

As shown in FIG. 6, different from the above-mentioned embodiment, the present embodiment lies in that: the port arranged at the water outlet end of each of the water supply pipelines 2 communicates with the water inlet end of the same flushing pipeline 6 by a pipeline provided with a control valve 7. The connecting pipeline 4 is provided with a plurality of ports, and each of the ports is connected with each of the liquid storage parts 3 in a one-to-one correspondence way by the corresponding control valve 7.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 6, in the present embodiment, a water inlet end of a first water supply pipeline 21 is provided with a first venturi tube 101, and a water outlet end of the first water supply pipeline 21 communicates with the first water tub 51. The water outlet end of each of the first water supply pipeline 21 and a second water supply pipeline 22 is provided with a port, the port of the first water supply pipeline 21 communicates with a water inlet end of a flushing pipeline 6 by a pipeline provided with a third control valve 73, and the port of the second water supply pipeline 22 communicates with the water inlet end of the flushing pipeline 6 by a pipeline provided with a fourth control valve 74.

In the present embodiment, a water outlet end of the connecting pipeline 4 respectively communicates with a pumping port 12 of the first venturi tube 101 by a pipeline provided with a first control valve 71 and a pumping port 12 of the second venturi tube 102 by a pipeline provided with a second control valve 72. Preferably, in order to avoid the situation that the water flows in the water supply pipelines 2 flow from the pumping ports 12 back to the connecting pipeline 4, an arrangement may be made as follows: each of a pipeline located between a labyrinth loop 40 and the pumping port 12 of the first venturi tube 101 and a pipeline located between the labyrinth loop 40 and the pumping port 12 of the second venturi tube 102 is provided with a one-way valve 8, and the one-way valves 8 control flow directions of liquids in the pipelines so as to ensure that the liquids in the pipelines always flow to one side of each of the venturi tubes 100 in a single direction.

In the present embodiment, the water inlet end of the connecting pipeline 4 communicates with the water outlet end of the flushing pipeline 6. The connecting pipeline 4 is provided with two ports, wherein one of the ports is connected with the first liquid storage part 31 by a fifth control valve 75, and the other port is connected with the second liquid storage part 32 by a sixth control valve 76.

When an additive A in the first liquid storage part 31 is fed into the first water tub 51, the automatic feeding device is in the following state:

the first control valve 71 is opened, the second control valve 72 is closed, the third control valve 73 and the fourth control valve 74 are closed, the fifth control valve 75 is opened, and the sixth control valve 76 is closed, at the moment, the first liquid storage part 31 communicates with the pumping port 12 of the first venturi tube 101 by the connecting pipeline 4, the additive A in the first liquid storage part 31 is pumped into the first water supply pipeline 21 with the inlet water flow and flows into the first water tub 51 with the water flow in the first water supply pipeline 21.

When an additive B in the second liquid storage part 32 is fed into the first water tub 51, the automatic feeding device is in the following state:

the first control valve 71 is opened, the second control valve 72 is closed, the third control valve 73 and the fourth control valve 74 are closed, the sixth control valve 76 is opened, and the fifth control valve 75 is closed, at the moment, the second liquid storage part 32 communicates with the pumping port 12 of the first venturi tube 101 by the connecting pipeline 4, the additive B in the second liquid storage part 32 is pumped into the first water supply pipeline 21 with the inlet water flow and flows into the corresponding first water tub 51 with the water flow in the first water supply pipeline 21.

When the additive A in the first liquid storage part 31 is fed into the second water tub 52, the automatic feeding device is in the following state:

the second control valve 72 is opened, the first control valve 71 is closed, the third control valve 73 and the fourth control valve 74 are closed, the fifth control valve 75 is opened, and the sixth control valve 76 is closed, at the moment, the first liquid storage part 31 communicates with the pumping port 12 of the second venturi tube 102 by the connecting pipeline 4, the additive A in the first liquid storage part 31 is pumped into the second water supply pipeline 22 with the inlet water flow and flows into the second water tub 52 with the water flow in the second water supply pipeline 22.

When the additive B in the second liquid storage part 32 is fed into the second water tub 52, the automatic feeding device is in the following state:

the second control valve 72 is opened, the first control valve 71 is closed, the third control valve 73 and the fourth control valve 74 are closed, the sixth control valve 76 is opened, and the fifth control valve 75 is closed, at the moment, the second liquid storage part 32 communicates with the pumping port of the second venturi tube 102 by the connecting pipeline 4, the additive B in the second liquid storage part 32 is pumped into the second water supply pipeline 22 with the inlet water flow and flows into the corresponding second water tub 52 with the water flow in the second water supply pipeline 22.

When the pumping structure 1 arranged on the first water supply pipeline 21 is flushed, the automatic feeding device is in the following state:

the first control valve 71 is opened, the second control valve 72 is closed, the third control valve 73 is opened, the fourth control valve 74 is closed, and the fifth control valve 75 and the sixth control valve 76 are closed, at the moment, the connecting pipeline 4 communicates with the flushing pipeline 6, the inlet water flow in the first water supply pipeline 21 directly flows into the connecting pipeline 4 through the flushing pipeline 6, returns to the first water supply pipeline 21 by the pumping port 12 of the first venturi tube 101 after flushing the connecting pipeline 4, and then flows from the water outlet end of the first water supply pipeline 21 to the corresponding first water tub 51, so that the aim that the residual additives in the connecting pipeline 4 and the first venturi tube 101 are flushed is achieved.

When the pumping structure 1 arranged on the second water supply pipeline 22 is flushed, the automatic feeding device is in the following state:

the second control valve 72 is opened, the first control valve 71 is closed, the fourth control valve 74 is opened, the third control valve 73 is closed, and the fifth control valve 75 and the sixth control valve 76 are closed, at the moment, the connecting pipeline 4 communicates with the flushing pipeline 6, the inlet water flow in the second water supply pipeline 22 directly flows into the connecting pipeline 4 through the flushing pipeline 6, returns to the second water supply pipeline 22 by the pumping port 12 of the second venturi tube 102 after flushing the connecting pipeline 4, and then flows from the water outlet end of the second water supply pipeline 22 to the corresponding second water tub 52, so that the aim that the residual additives in the connecting pipeline 4 and the second venturi tube 102 are flushed is achieved.

Embodiment 11

Figure 7:
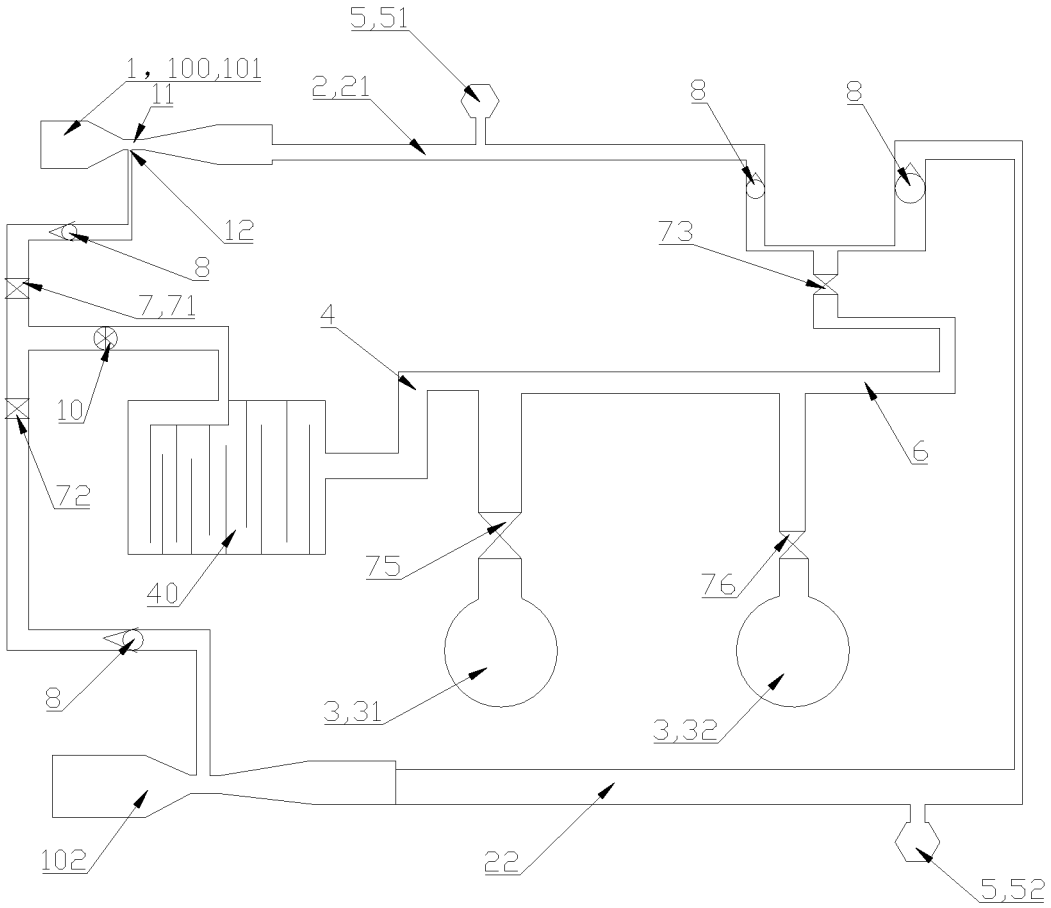

As shown in FIG. 7, different from above-mentioned embodiment 10, the present embodiment lies in that: the port arranged at the water outlet end of each of the water supply pipelines 2 is connected with a water inlet end of a flushing pipeline 6 by a pipeline provided with a one-way valve 8, and the water inlet end of the flushing pipeline 6 is provided with a third control valve 73 for controlling on/off of the pipeline.

Due to such an arrangement, when the additives are fed into the water tubs by the automatic feeding device, the third control valve 73 is closed, inlet water flowing through the first water supply pipeline 21 or the second water supply pipeline 22 is incapable of flowing into the flushing pipeline 6 under the action of the closed third control valve 73 and is incapable of flowing into the other water supply pipeline 2 due to limitations from the one-way valve 8, and the inlet water flow is enabled to totally flow into the corresponding water tubs 5, so that the aim that any one of the water tubs 5 is supplied with water or automatically fed with the additives is achieved.

Meanwhile, when each of the pumping structures 1 is flushed by the automatic feeding device, the third control valve 73 is opened, the inlet water flowing through the first water supply pipeline 21 or the second water supply pipeline 22 is incapable of flowing into the other water supply pipeline 2 due to limitations from the one-way valve 8, a part of the inlet water flow is enabled to flow into the corresponding water tub 5, the other part of the inlet water flow flows into the connecting pipeline 4 through the flushing pipeline 6, flushing water returns to the corresponding water supply pipeline 2 through the corresponding pumping structure 1, and the returned flushing water flows into the corresponding water tub 5 along the corresponding water supply pipeline 2, so that the aim that the corresponding pumping structure 1 is flushed is achieved.

Embodiment 12

Figure 8:
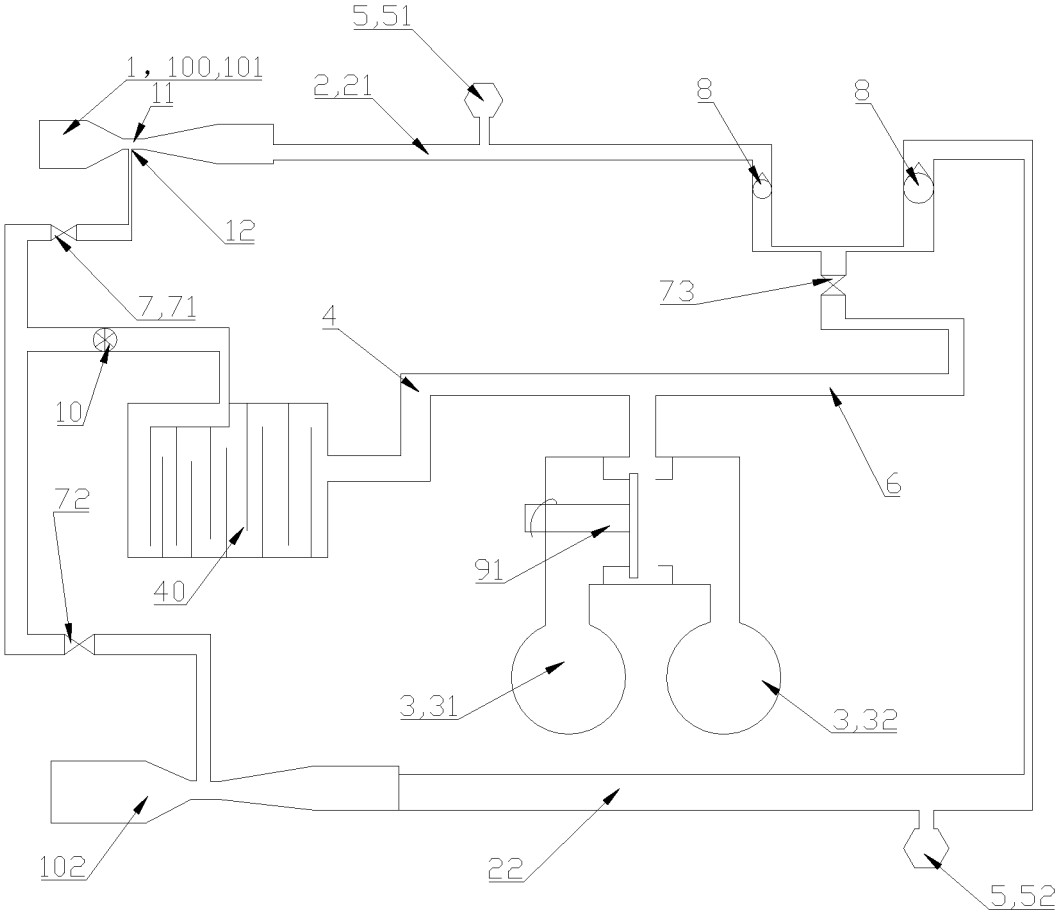

As shown in FIG. 8, different from above-mentioned embodiment 11, the present embodiment lies in that: the connecting line 4 is connected with a reversing valve 9 which is a first reversing valve 91; the first reversing valve 91 is a valve body with one outlet and a plurality of inlets, each of the inlets of the first reversing valve 91 communicates with each of the liquid storage parts 3 in a one-to-one correspondence way, and the outlet of the first reversing valve 91 communicates with the connecting pipeline 4.

Due to such an arrangement, when different additives are fed into the water tubs 5 by the automatic feeding device, a valve element of the first reversing valve 91 is correspondingly regulated to enable the first liquid storage part 31 or the second liquid storage part 32 to communicate with the pumping port 12 of the pumping structure 1 arranged on the corresponding water supply pipeline 2 by the connecting pipeline 4, so that the aim that the different types of additives are respectively fed into the different water tubs 5 is achieved.

Embodiment 13

Different from the above-mentioned embodiment, the present embodiment lies in that: the water outlet end of each of the water supply pipelines 2 communicates with the same connecting pipeline 4 by a different flushing pipeline 6, and each of the flushing pipelines 6 is provided with a control valve 7 for controlling on/off of the pipeline, so that the aim that the automatic feeding device is automatically flushed by virtue of inlet water of the different water supply pipelines 2 is achieved (not shown in the figure).

Embodiment 14

Different from the above-mentioned embodiment, the present embodiment lies in that: the pumping port 12 of the pumping structure 1 arranged on each of the water supply pipelines 2 communicates with a different connecting pipeline 4 in a one-to-one correspondence way, any one of the connecting pipelines 4 communicates with each of the liquid storage parts 3 in a one-to-one correspondence way by a pipeline provided with a control valve 7 or communicates with one of the liquid storage parts 3 by a reversing valve 9, so that the aim that the additives are respectively fed into the corresponding water supply pipelines 2 by the different connecting pipelines 4 is achieved (not shown in the figure).

Embodiment 15

Different from the above-mentioned embodiment, the present embodiment lies in that: the pumping port 12 of the pumping structure 1 arranged on each of the water supply pipelines 2 communicates with a different connecting pipeline 4 in a one-to-one correspondence way, any one of the connecting pipelines 4 communicates with each of the liquid storage parts 3 in a one-to-one correspondence way by a pipeline provided with a control valve 7 or communicates with one of the liquid storage parts 3 by a reversing valve 9, so that the aim that the additives are respectively fed into the corresponding water supply pipelines 2 by different connecting pipelines 4 is achieved (not shown in the figure).

Embodiment 16

The present embodiment introduces a control method of the automatic feeding device applied to any one of above-mentioned embodiments 8-15, when the additives are fed, a water flow at a water supply source flows to the corresponding water tub by one of the water supply pipelines, the additives in the liquid storage parts are pumped out by virtue of a negative pressure generated when the water flow flows through the pumping structure, enter the corresponding water supply pipeline by the pumping port, and are then flushed into the corresponding water tub with the water flow in the water supply pipeline.

In the present embodiment, when the pumping structures are flushed, the water supply pipelines communicate with the flushing pipeline, the liquid storage parts are disconnected with the pumping structures, the water flows in the water supply pipelines flow to the pumping structures through the flushing pipeline, and then return to the water supply pipelines by the pumping ports of the pumping structures; and preferably, when the pumping structures are flushed, the water outlet ends of the water supply pipelines communicate with the flushing pipeline and one of the water outlets, parts of the water flows in the water supply pipelines flow to one of the water outlets, and the other parts of the water flows flow to the flushing pipeline, and after the pumping structures are flushed by the flushing pipeline, flushing water returning from the pumping ports to the flushing pipeline may flow out of one of the water outlets.

In the present embodiment, the different types of additives stored in the plurality of liquid storage parts may be respectively fed by the automatic feeding device. When the additives are fed by the automatic feeding device, one of the pumping ports communicates with each of liquid storage parts, so that the corresponding liquid storage parts communicate with the water supply pipelines, and the additives stored in the corresponding liquid storage parts are pumped into the water supply pipelines and are flushed into the corresponding water tubs with the inlet water flows.

A multi-drum washing machine provided with two water tubs respectively being a first water tub and a second water tub and two liquid storage parts respectively being a first liquid storage part and a second liquid storage part is taken as an example to be described below, and the specific control method is described as follows:

when an additive A stored in the first liquid storage part is fed into the first water tub, the first water supply pipeline of the automatic feeding device supplies washing water to the first water tub, during water supply, an outlet of the first liquid storage part is interruptedly opened, when the outlet of the first liquid storage part is opened, the additive A stored in the first liquid storage part is pumped into the first water supply pipeline by the pumping structure on the first water supply pipeline by virtue of the connecting pipeline and is flushed into the first water tub with the inlet water flow; and within the time period when the outlet of the first liquid storage part is closed, a part of the water flow in the first water supply pipeline flows into the pumping structure through the flushing pipeline and the connecting pipeline to flush the residual additive A in the pumping structure and the connecting pipeline, so that the additive A which is pumped and fed once is totally flushed into the first water tub with a flushing water flow.

When the additive A stored in the first liquid storage part is fed into the second water tub, the second water supply pipeline of the automatic feeding device supplies washing water to the second water tub, during water supply, the outlet of the first liquid storage part is interruptedly opened, when the outlet of the first liquid storage part is opened, the additive A stored in the first liquid storage part is pumped into the second supply pipeline by the pumping structure on the second water supply pipeline by virtue of the connecting pipeline and is flushed into the second water tub with the inlet water flow; and within the time period when the outlet of the first liquid storage part is closed, a part of the water flow in the second water supply pipeline flows into the pumping structure through the flushing pipeline and the connecting pipeline to flush the residual additive A in the pumping structure and the connecting pipeline, so that the additive A which is pumped and fed once is totally flushed into the second water tub with a flushing water flow.

When an additive B stored in the second liquid storage part is fed into the first water tub, the first water supply pipeline of the automatic feeding device supplies washing water to the first water tub, during water supply, an outlet of the second liquid storage part is interruptedly opened, when the outlet of the second liquid storage part is opened, the additive B stored in the second liquid storage part is pumped into the first water supply pipeline by the pumping structure on the first water supply pipeline by virtue of the connecting pipeline and is flushed into the first water tub with the inlet water flow; and within the time period when the outlet of the second liquid storage part is closed, a part of the water flow in the first water supply pipeline flows into the pumping structure through the flushing pipeline and the connecting pipeline to flush the residual additive B in the pumping structure and the connecting pipeline, so that the additive B which is pumped and fed once is totally flushed into the first water tub with a flushing water flow.

When the additive B stored in the second liquid storage part is fed into the second water tub, the second water supply pipeline of the automatic feeding device supplies washing water to the second water tub, during water supply, the outlet of the second liquid storage part is interruptedly opened, when the outlet of the second liquid storage part is opened, the additive B stored in the second liquid storage part is pumped into the second water supply pipeline by the pumping structure on the second water supply pipeline by virtue of the connecting pipeline and is flushed into the second water tub with the inlet water flow; and within the time period when the outlet of the second liquid storage part is closed, a part of the water flow in the second water supply pipeline flows into the pumping structure through the flushing pipeline and the connecting pipeline to flush the residual additive B in the pumping structure and the connecting pipeline, so that the additive B which is pumped and fed once is totally flushed into the second water tub with a flushing water flow.

Embodiment 17

As shown in FIG. 9 to FIG. 12, the embodiment of the present disclosure introduces a multi-drum washing machine, including a plurality of water tubs 5 arranged to be independent from each other, wherein each of the water tubs 5 is capable of respectively treating clothes; the washing machine is provided with a water inlet structure for introducing an external water flow to the inside of the washing machine; and the washing machine is further provided with an automatic feeding device for feeding additives into the corresponding water tubs 5 with an inlet water flow flowing with the water inlet structure so as to treat the clothes in the corresponding water tubs 5 by using the additives fed with the inlet water flow.

In the embodiment of the present disclosure, the additives include, but are not limited to the following additives: a detergent, a softener, a disinfectant, a flavoring agent and a bleaching agent.

As shown in FIG. 9 to FIG. 12, the embodiment of the present disclosure further introduces an automatic feeding device which may be applied to the above-mentioned multi-drum washing machine and used for feeding the additives to the corresponding water tubs 5 of the washing machine; and the automatic feeding device may also be applied to any existing equipment so as to feed the corresponding additives into any waterway channel in the equipment.

The automatic feeding device in the embodiment of the present disclosure includes: at least two water outlets; liquid storage parts 3, containing additives used when clothes are treated; and at least two water supply pipelines 2, wherein a water inlet end of each of the water supply pipelines 2 communicates with the same water supply source, a water outlet end of each of the water supply pipelines 2 controllably communicates with one of the water outlets, so that inlet water is delivered to the corresponding water outlet by each of the water supply pipelines 2. Each of the water supply pipelines 2 is provided with a pumping structure 1 capable of generating a negative pressure by virtue of a water flow flowing through the corresponding water supply pipeline to pump and deliver the additives in the liquid storage parts 3 to the water supply pipeline 2 and enable the additives to flow to the corresponding water outlet with the water flow. In the embodiment of the present disclosure, when the automatic feeding device is mounted on a multi-drum washing machine, each of the water outlets of the automatic feeding device communicates with each of the water tubs 5 of the washing machine in a one-to-one correspondence way, a water supply source is supplied by the water inlet structure of the washing machine, so that the additives are fed into the corresponding water tubs 5 together with the inlet water flow in a process that washing water enters the corresponding water tubs 5 of the multi-drum washing machine. Of course, for meeting the design demand of the washing machine, the number of the water outlets of the automatic feeding device may also be set to be different from that of the water tubs to ensure that at least one of the water tubs corresponds to a plurality of the water outlets, or at least one of the water outlets corresponds to a plurality of the water tubs.

Due to the above-mentioned arrangement, the additives may be fed to the corresponding water outlets by the automatic feeding device by virtue of different pumping structures, so that the aim that the additives are respectively fed to a plurality of positions by using a set of system is achieved. Meanwhile, the above-mentioned automatic feeding device is mounted on the multi-drum washing machine, so that the aim that a set of additive feeding system is shared by the plurality of water tubs of the multi-drum washing machine to controllably feed the additives into one of the water tubs with the inlet water flow is achieved. Moreover, the additives respectively and controllably flow into one of the water tubs by the plurality of water supply pipelines on the automatic feeding device, so that the aim that the additives may be respectively fed into any one of the water tubs by each of the water supply pipelines is achieved, and furthermore, the effect that the additives may be respectively fed into each of the water tubs of the multi-drum washing machine by a plurality of paths of water flows is achieved.

The automatic feeding device in the embodiment of the present disclosure further includes a flushing pipeline 6; water flows at water outlet ends of the water supply pipelines 2 are directly introduced to the pumping structures 1 by the flushing pipeline 6, and then circularly return to the water supply pipelines 2 by virtue of the pumping structures 1, and the pumping structures 1 are flushed by using circulating water, so that residual additives in the pipelines are flushed by using flushing water after the additives are fed once by the automatic feeding device, and furthermore, it is ensured that the additives fed when the automatic feeding device is started every time are all discharged into the water supply pipelines with the water flows; and meanwhile, the aim of flushing the automatic feeding device to prevent the residual additives from affecting the subsequence use of the device is achieved. Preferably, the flushing pipeline 6 may be provided with a one-way valve 8 for ensuring the water flow in the pipeline flows from a water inlet end to the water outlet end in a single direction; and preferably, the flushing pipeline 6 may be provided with a control valve 7 for controlling the water flow to flow in the pipeline or not.

The automatic feeding device in the embodiment of the present disclosure includes at least two liquid storage parts 3, wherein different types of additives may be respectively stored in the liquid storage parts 3. Each of the liquid storage parts 3 communicates with a pumping port of each of the pumping structures 1 by a different connecting pipeline 4, and each of the connecting pipelines 4 is provided with a control valve 7 for controlling the on/off of the pipeline; or, each of the at least two liquid storage parts 3 is connected with the same connecting pipeline 4 by a pipeline provided with a control valve 7; or, the at least two liquid storage parts 3 are connected with the same connecting pipeline 4 by reversing valves 9, and each of the liquid storage parts 3 is enabled to communicate with one of the connecting pipelines 4 under the action of the reversing valves 9; or, the pumping port of each of the at least two pumping structures 1 is connected with the same connecting pipeline 4 by a pipeline provided with a control valve 7; or the connecting pipelines 4 are connected with the pumping ports of the at least two pumping structures 1 by the reversing valves 9, and the connecting pipelines 4 are enabled to communicate with the pumping port of one of the pumping structures 1 under the action of the reversing valves 9.

Embodiment 18

Figure 9:
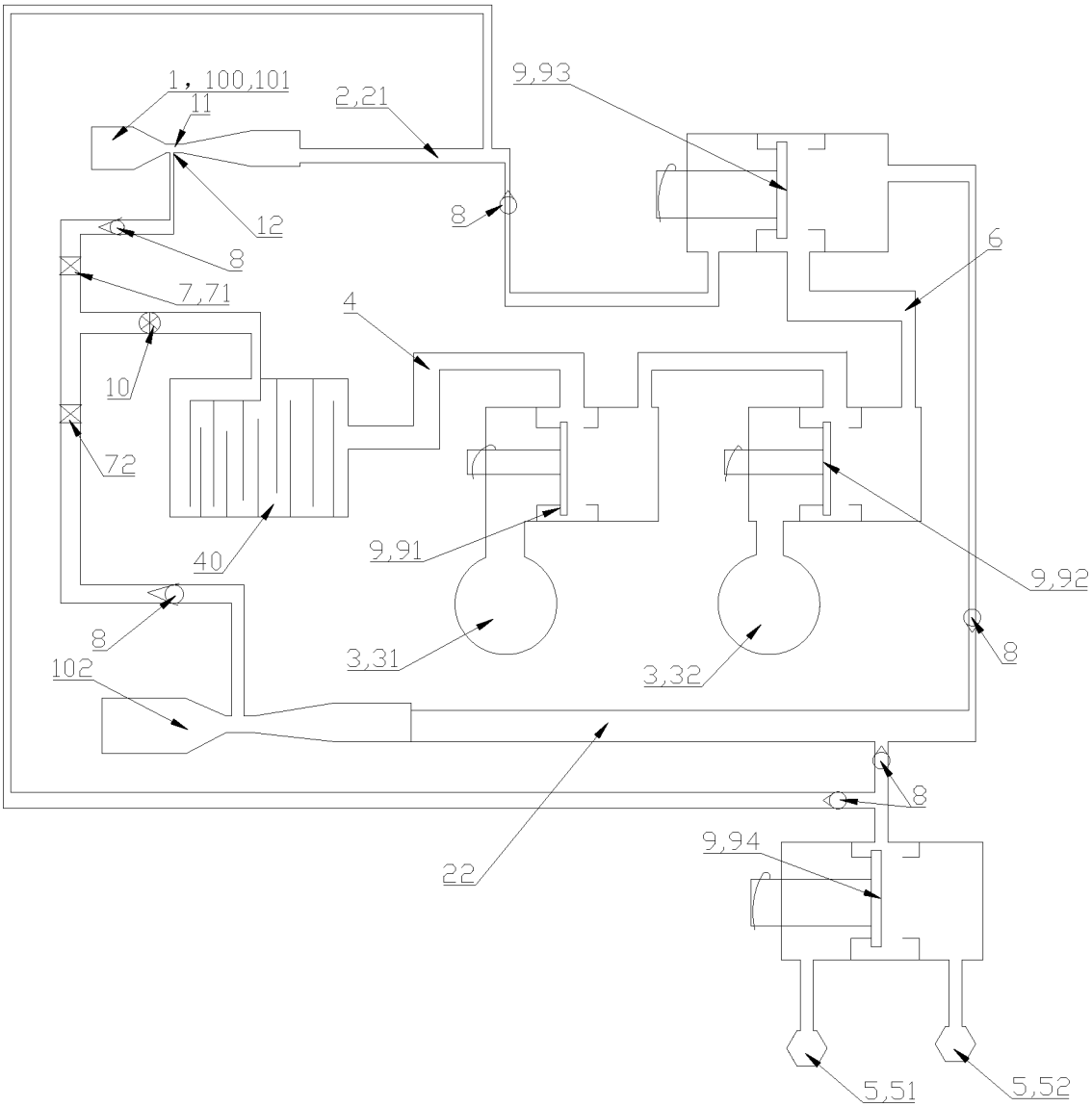

As shown in FIG. 9, the present embodiment introduces an automatic feeding device, including liquid storage parts 3, containing additives used when clothes are treated; and at least two water supply pipelines 2, wherein a water inlet end of each of the water supply pipelines 2 communicates with a water inlet structure of a multi-drum washing machine, a water outlet end of each of the water supply pipelines 2 communicates with an inlet of a reversing valve, each of outlets of the reversing valve communicates with each of the water tubs 5 in a one-to-one correspondence way to enable inlet water of the washing machine to be respectively delivered to the corresponding water tub 5 by one of the water supply pipelines 2, so that the aim that washing water enters any one of the water tubs 5 of the multi-drum washing machine is achieved. Each of the water supply pipelines 2 is provided with a pumping structure 1 capable of generating a negative pressure by virtue of an inlet water flow flowing through the corresponding water supply pipeline 2 to pump and deliver the additives in the liquid storage parts 3 to the water supply pipeline 2 and enable the additives to be fed into the corresponding water tub 5 of the washing machine with the inlet water flow. In the embodiment of the present disclosure, when the automatic feeding device is mounted on the multi-drum washing machine, each of water outlets of the automatic feeding device communicates with each of the water tubs 5 of the washing machine in a one-to-one correspondence way, a water supply source is supplied by the water inlet structure of the washing machine, so that the additives are fed into the corresponding water tubs 5 together with the inlet water flows in a process that washing water enters the corresponding water tubs 5 of the multi-drum washing machine, and furthermore, the aim that the additives are automatically fed into the corresponding water tubs 5 with the inlet water flows is achieved.

In the present embodiment, each of the pumping structures 1 includes a venturi tube 100 arranged in each of the water supply pipelines 2 and capable of generating a negative pressure by virtue of the flowing of the water flow, and a negative pressure region 11 is provided with a pumping port 12 communicating with the liquid storage parts 3 and used for pumping the additives into the water flow of each of the water supply pipelines by virtue of the negative pressure. In the present embodiment, two ends of the venturi tube 100 are both connected into each of the water supply pipelines 2 and respectively and correspondingly communicate with the water inlet end and the water outlet end; and the middle of the venturi tube 100 is provided with a necking part of which the inner tube diameter is suddenly reduced. Since the tube wall inner diameter of the necking part is suddenly reduced, the flow rate of the water flow in the region is suddenly increased so that the necking part forms a negative pressure region 11 where a negative pressure is generated with the flowing of the water flow, the negative pressure region 11 is provided with a port communicating with the outside, and the port forms the pumping port 12, communicating with the liquid storage parts 3 by a connecting pipeline 4, of the pumping structure 1. Due to the above-mentioned arrangement, the pumping structure is enabled to be directly composed of the venturi tube generating a negative pressure pumping effect with the change of the flow rate of the water flow, so that the aim that the additives stored in the liquid storage parts are pumped into the inlet water flow with the inlet water flow is achieved.

In the present embodiment, the water outlet end of each of the water supply pipelines 2 communicates with an inlet of the same fourth reversing valve 94 which is provided with one inlet and a plurality of outlets, and each of the outlets of the fourth reversing valve 94 communicates with each of the different water tubs 5 in one-to-one correspondence to the outlets. Preferably, the water supply pipelines 2 are provided with one-way valves 8 for ensuring the water flows in the pipelines flow from water inlet source ends to the water outlet ends in a single direction. Therefore, by using the automatic feeding device, the aim that the different water tubs are respectively supplied with water and fed with the additives is achieved due to water supply from different water supply flow channels.

In the present embodiment, the automatic feeding device further includes a flushing pipeline 6; a water inlet end of the flushing pipeline 6 communicates with parts, located at the downstream of the venturi tubes 100 and the upstream of a third reversing valve 93, of the water supply pipelines 2, the water outlet end of the flushing pipeline 6 communicates with one end of the connecting pipeline 4, and the other end of the connecting pipeline 4 communicates with the pumping ports of the pumping structures 1. Due to the above-mentioned arrangement, water flows at water outlet ends of the water supply pipelines 2 are directly introduced to the pumping structures 1, and then circularly return to the water supply pipelines 2 through the pumping structures, and the pumping structures are flushed by using circulating water, so that the residual additives in the pipelines are flushed by using flushing water after the additives are fed once by the automatic feeding device, and furthermore, it is ensured that the additives fed when the automatic feeding device is started every time are all discharged into the water supply pipelines with the water flows; and meanwhile, the aim of flushing the automatic feeding device to prevent the residual additives from affecting the subsequence use of the device is achieved. Preferably, the flushing pipeline 6 may be provided with a one-way valve 8 for ensuring the water flow in the pipeline flows from a water inlet end to the water outlet end in a single direction; and preferably, the flushing pipeline 6 may be provided with a control valve 7 for controlling the water flow to flow in the pipeline or not.

In the present embodiment, in order to guarantee the flowing singleness of a fluid in each pipeline, a pipeline, communicating with the fourth reversing valve 94, on the water outlet end of each of the water supply pipelines is provided with a one-way valve 8, so that it is ensured that a water flow in the fourth reversing valve may not flow back to the water supply pipeline.

In the present embodiment, the automatic feeding device includes at least two liquid storage parts 3, wherein the liquid storage parts 3 are respectively fed with different types of additives, so that the aim that the different types of additives are automatically fed by classification by the automatic feeding device is achieved.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 9, in the present embodiment, a water inlet end of a first water supply pipeline 21 is provided with a first venturi tube 101, and a water inlet end of the second water supply pipeline 22 is connected with a second venturi tube 102, and water outlet ends of both the first water supply pipeline 21 and the second water supply pipeline 22 communicate with the inlet of the fourth reversing valve 94. The fourth reversing valve 94 is provided with two outlets and one inlet, wherein the two outlets respectively communicate with the first water tub 51 and the second water tub 52, and the inlet communicates with the water outlet ends of both the first water supply pipeline 21 and the second water supply pipeline 22.

In the present embodiment, the water outlet end of each of the first water supply pipeline 21 and the second water supply pipeline 22 is provided with a port, and the two ports communicate with an inlet of the same flushing pipeline by a reversing valve 9; and the reversing valve 9 is a third reversing valve 93 which is provided with two inlets and one outlet, wherein the two inlets respectively communicate with the ports of the first water supply pipeline 21 and the second water supply pipeline 22, and the outlet communicates with a water inlet end of the flushing pipeline 6.

In the present embodiment, a water outlet end of the connecting pipeline 4 respectively communicates with a pumping port 12 of the first venturi tube 101 by a pipeline provided with a first control valve 71 and a pumping port of the second venturi tube 102 by a pipeline provided with a second control valve 72. Preferably, in order to avoid the situation that the water flows in the water supply pipelines 2 flow from the pumping ports 12 back to the connecting pipeline 4, an arrangement may be made as follows: each of a pipeline located between a labyrinth loop 40 and the pumping port of the first venturi tube 101 and a pipeline located between the labyrinth loop 40 and the pumping port of the second venturi tube 102 is provided with a one-way valve 8, and the one-way valves 8 control flow directions of liquids in the pipelines so as to ensure that the liquids in the pipelines always flow to one side of each of the venturi tubes 100 in a single direction.

In the present embodiment, the water inlet end of the connecting pipeline 4 communicates with the water outlet end of the flushing pipeline 6; and preferably, a connection part may be provided with a control valve 7 for controlling on/off, so that the aim that the automatic feeding device is switched to feed the additives and flush the pipelines is achieved.

When an additive A in the first liquid storage part 31 is fed into the first water tub 51 by the first water supply pipeline 21, the automatic feeding device is in the following state:

an outlet of a first reversing valve 91 communicates with a second inlet and is disconnected with a first inlet, the first control valve 71 is opened, the second control valve 72 is closed, the second inlet of the third reversing valve 93 communicates with the outlet, and the inlet of the fourth reversing valve 94 communicates with the first outlet, at the moment, the first liquid storage part 31 communicates with the pumping port 12 of the first venturi tube 101 by the connecting pipeline 4, the additive A in the first liquid storage part 31 is pumped into the first water supply pipeline 21 with the inlet water flow and flows into the first water tub 51 with the water flow in the first water supply pipeline 21.

When an additive B in the second liquid storage part 32 is fed into the first water tub 51 by the first water supply pipeline 21, the automatic feeding device is in the following state:

the outlet of the first reversing valve 91 communicates with the first inlet and is disconnected with the second inlet, an outlet of a second reversing valve 92 communicates with a second inlet and is disconnected with a first inlet, the first control valve 71 is opened, the second control valve 72 is closed, the inlet of the fourth reversing valve 94 communicates with the first outlet, and the second inlet of the third reversing valve 93 communicates with the outlet, at the moment, the second liquid storage part 32 communicates with the pumping port of the first venturi tube 101 by the connecting pipeline 4, the additive B in the second liquid storage part 32 is pumped into the first water supply pipeline 21 with the inlet water flow and flows into the corresponding first water tub 51 with the water flow in the first water supply pipeline 21.

Similarly, when the additive A in the first liquid storage part 31 or the additive B in the second liquid storage part 32 is fed into the first water tub 51 by the second water supply pipeline 22, the inlet of the fourth reversing valve 94 still communicates with the first outlet, so that the inlet water and the additive in the second water supply pipeline flow into the first water tub 51.

When the additive A in the first liquid storage part 31 is fed into the second water tub 52 by the second water supply pipeline 22, the automatic feeding device is in the following state:

the outlet of the first reversing valve 91 communicates with the second inlet and is disconnected with the first inlet, the first control valve 71 is closed, the second control valve 72 is opened, the first inlet of the third reversing valve 93 communicates with the outlet, and the inlet of the fourth reversing valve 94 communicates with the second outlet, at the moment, the first liquid storage part 31 communicates with the pumping port 12 of the second venturi tube 102 by the connecting pipeline 4, the additive Ain the first liquid storage part 31 is pumped into the second water supply pipeline 22 with the inlet water flow and flows into the second water tub 52 with the water flow in the second water supply pipeline 22.

When the additive B in the second liquid storage part 32 is fed into the second water tub by the second water supply pipeline 22, the automatic feeding device is in the following state:

the outlet of the first reversing valve 91 communicates with the first inlet and is disconnected with the second inlet, the outlet of the second reversing valve 92 communicates with the second inlet and is disconnected with the first inlet, the first control valve 71 is closed, the second control valve 72 is opened, the first inlet of the third reversing valve 93 communicates with the outlet, and the inlet of the fourth reversing valve 94 communicates with the second outlet, at the moment, the second liquid storage part 32 communicates with the pumping port of the second venturi tube 102 by the connecting pipeline 4, the additive B in the second liquid storage part 32 is pumped into the second water supply pipeline 22 with the inlet water flow and flows into the corresponding second water tub 52 with the water flow in the second water supply pipeline 22.

Similarly, when the additive A in the first liquid storage part 31 or the additive B in the second liquid storage part 32 is fed into the first water tub 52 by the first water supply pipeline 21, the inlet of the fourth reversing valve 94 still communicates with the second outlet, so that the inlet water and the additive in the first water supply pipeline flow into the second water tub 52.

When the pumping structure 1 arranged on the first water supply pipeline 21 is flushed, the automatic feeding device is in the following state:

the outlet of the first reversing valve 91 communicates with the first inlet and is disconnected with the second inlet, the outlet of the second reversing valve 92 communicates with the first inlet and is disconnected with the second inlet, the first control valve 71 is opened, the second control valve 72 is closed, the first inlet of the third reversing valve 93 communicates with the outlet, and the inlet of the fourth reversing valve 94 may communicate with any one of the outlets, at the moment, the connecting pipeline 4 communicates with the flushing pipeline 6, the inlet water flow in the first water supply pipeline 21 directly flows into the connecting pipeline 4 by virtue of the flushing pipeline 6, returns to the first water supply pipeline 21 by the pumping port of the first venturi tube 101 after flushing the connecting pipeline 4, and then flows from the water outlet end of the first water supply pipeline 21 to the corresponding first water tub 51 or second water tub 52, so that the aim that the residual additives in the connecting pipeline 4 and the first venturi tube 101 are flushed is achieved.

When the pumping structure 1 arranged on the second water supply pipeline 22 is flushed, the automatic feeding device is in the following state:

the outlet of the first reversing valve 91 communicates with the first inlet and is disconnected with the second inlet, the outlet of the second reversing valve 92 communicates with the first inlet and is disconnected with the second inlet, the second control valve 72 is opened, the first control valve 71 is closed, the second inlet of the third reversing valve 93 communicates with the outlet, and the inlet of the fourth reversing valve 94 may communicate with any one of the outlets, at the moment, the connecting pipeline 4 communicates with the flushing pipeline 6, the inlet water flow in the second water supply pipeline 22 directly flows into the connecting pipeline 4 through the flushing pipeline 6, returns to the second water supply pipeline 22 by the pumping port 12 of the second venturi tube 102 after flushing the connecting pipeline 4, and then flows from the water outlet end of the second water supply pipeline 22 to the corresponding first water tub 51 or second water tub 52, so that the aim that the residual additives in the connecting pipeline 4 and the second venturi tube 102 are flushed is achieved.

In the present embodiment, in order to increase the feeding amount of the additives fed once by the automatic feeding device, the connecting pipeline 4 is provided with a labyrinth loop 40; and the labyrinth loop 40 is composed of a flow channel arranged to be swirled and capable of extending the axial length of the pipeline, and two ends of the flow channel respectively communicate with the liquid storage parts 3 and the pumping ports 12 of the pumping structures 1.

In the present embodiment, in order to realize metering detection of the feeding amount of the additives, an arrangement may be made as follows: the connecting pipeline 4 located between the labyrinth loop 40 and the pumping port 12 of each of the pumping structures is provided with a metering device 10 for detecting the flow of a flowing liquid.

Embodiment 19

Figure 10:
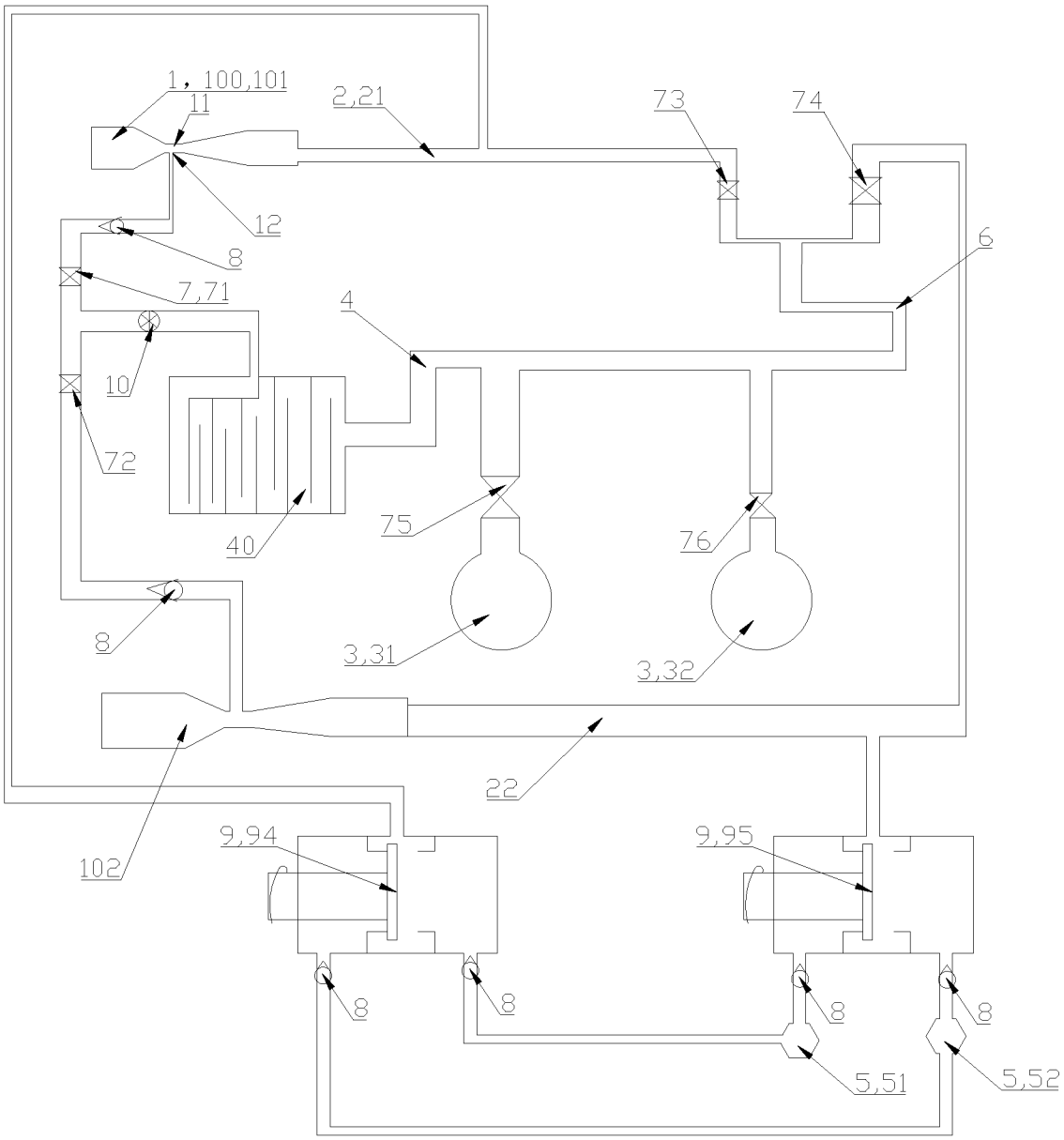

As shown in FIG. 10, different from the above-mentioned embodiment, the present embodiment lies in that: the port arranged at the water outlet end of each of the water supply pipelines 2 communicates with the water inlet end of the same flushing pipeline 6 by a pipeline provided with a control valve 7. The connecting pipeline 4 is provided with a plurality of ports, and each of the ports is connected with each of the liquid storage parts 3 in a one-to-one correspondence way by the corresponding control valve 7.

In the present embodiment, the water outlet ends of the water supply pipelines 2 respectively communicate with inlets of corresponding reversing valves 9 in one-to-one correspondence to the water outlet ends, each of the reversing valves 9 is provided with one inlet and a plurality of outlets, and the outlets of each of the reversing valves 9 respectively communicate with the water tubs 5 in a one-to-one correspondence way, so that each of the water supply pipelines 2 communicates with one of water tubs 5 by the corresponding reversing valve 9.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 10, in the present embodiment, a water inlet end of a first water supply pipeline 21 is provided with a first venturi tube 101, and a water inlet end of a second water supply pipeline 22 is provided with a second venturi tube 102. A water outlet end of the first water supply pipeline 21 communicates with an inlet of a fourth reversing valve 94, and a water outlet end of the second water supply pipeline 22 communicates with an inlet of a fifth reversing valve 95. Each of the fourth reversing valve and the fifth reversing valve is provided with one inlet and two outlets, wherein the first outlets of both the fourth reversing vale 94 and the fifth reversing valve 95 communicate with the first water tub 51, and the second outlets of both the fourth reversing vale 94 and the fifth reversing valve 95 communicate with the second water tub 52.

In the present embodiment, in order to guarantee correct water flow directions in the pipelines, each of the outlets of the fourth reversing valve and the fifth reversing valve is provided with a one-way valve 8 for ensuring that washing water in each of the water tubs may not flow back to the fourth reversing valve or the fifth reversing valve along the pipelines.

In the present embodiment, the water outlet end of each of the first water supply pipeline 21 and the second water supply pipeline 22 is provided with a port, the port of the first water supply pipeline 21 communicates with the water inlet end of a flushing pipeline 6 by a pipeline provided with a third control valve 73, and the port of the second water supply pipeline 22 communicates with the water inlet end of the flushing pipeline 6 by a pipeline provided with a fourth control valve 74.

In the present embodiment, a water outlet end of the connecting pipeline 4 respectively communicates with a pumping port 12 of the first venturi tube 101 by a pipeline provided with a first control valve 71 and a pumping port 12 of the second venturi tube 102 by a pipeline provided with a second control valve 72. Preferably, in order to avoid the situation that the water flows in the water supply pipelines 2 flow from the pumping ports 12 back to the connecting pipelines 4, an arrangement may be made as follows: each of a pipeline located between a labyrinth loop 40 and the pumping port 12 of the first venturi tube 101 and a pipeline located between the labyrinth loop 40 and the pumping port 12 of the second venturi tube 102 is provided with a one-way valve 8, and the one-way valves 8 control flow directions of liquids in the pipelines so as to ensure that the liquids in the pipelines always flow to one side of each of the venturi tubes 100 in a single direction.

In the present embodiment, the water inlet end of the connecting pipeline 4 communicates with the water outlet end of the flushing pipeline 6. The connecting pipeline 4 is provided with two ports, wherein one of the ports is connected with the first liquid storage part 31 by a fifth control valve 75, and the other port is connected with the second liquid storage part 32 by a sixth control valve 76.

When an additive A in the first liquid storage part 31 is fed into the first water tub 51 by the first water supply pipeline 21, the automatic feeding device is in the following state:
the first control valve 71 is opened, the second control valve 72 is closed, the third control valve 73 and the fourth control valve 74 are closed, the fifth control valve 75 is opened, the sixth control valve 76 is closed, and the inlet of the fourth reversing valve 94 communicates with the first outlet, at the moment, the first liquid storage part 31 communicates with the pumping port 12 of the first venturi tube 101 by the connecting pipeline 4, the additive A in the first liquid storage part 31 is pumped into the first water supply pipeline 21 with the inlet water flow and flows into the first water tub 51 with the water flow in the first water supply pipeline 21.

When an additive B in the second liquid storage part 32 is fed into the first water tub 51 by the first water supply pipeline 21, the automatic feeding device is in the following state:
the first control valve 71 is opened, the second control valve 72 is closed, the third control valve 73 and the fourth control valve 74 are closed, the sixth control valve 76 is opened, the fifth control valve 75 is closed, and the inlet of the fourth reversing valve 94 communicates with the first outlet, at the moment, the second liquid storage part 32 communicates with the pumping port 12 of the first venturi tube 101 by the connecting pipeline 4, the additive B in the second liquid storage part 32 is pumped into the first water supply pipeline 21 with the inlet water flow and flows into the corresponding first water tub 51 with the water flow in the first water supply pipeline 21.

Similarly, when the additive is fed into the first water tub 51 by the second water supply pipeline 22, the inlet of the fifth reversing valve 95 is required to communicate with the first outlet, so that water, a detergent and the like flowing into the second water supply pipeline directly flow to the first water tub 51.

When the additive A in the first liquid storage part 31 is fed into the second water tub 52 by the second water supply pipeline 22, the automatic feeding device is in the following state:
the second control valve 72 is opened, the first control valve 71 is closed, the third control valve 73 and the fourth control valve 74 are closed, the fifth control valve 75 is opened, the sixth control valve 76 is closed, and the inlet of the fifth reversing valve 95 communicates with the second outlet, at the moment, the first liquid storage part 31 communicates with the pumping port 12 of the second venturi tube 102 by the connecting pipeline 4, the additive A in the first liquid storage part 31 is pumped into the second water supply pipeline 22 with the inlet water flow and flows into the second water tub 52 with the water flow in the second water supply pipeline 22.

When the additive B in the second liquid storage part 32 is fed into the second water tub 52 by the second water supply pipeline 22, the automatic feeding device is in the following state:
the second control valve 72 is opened, the first control valve 71 is closed, the third control valve 73 and the fourth control valve 74 are closed, the sixth control valve 76 is opened, the fifth control valve 75 is closed, and the inlet of the fourth reversing valve 94 communicates with the second outlet, at the moment, the second liquid storage part 32 communicates with the pumping port of the second venturi tube 102 by the connecting pipeline 4, the additive B in the second liquid storage part 32 is pumped into the second water supply pipeline 22 with the inlet water flow and flows into the corresponding second water tub 52 with the water flow in the second water supply pipeline 22.

Similarly, when the additive is fed into the second water tub 52 by the first water supply pipeline 21, the inlet of the fourth reversing valve 94 is required to communicate with the second outlet, so that water, a detergent and the like flowing into the second water supply pipeline directly flow to the second water tub 52.

When the pumping structure 1 arranged on the first water supply pipeline 21 is flushed, the automatic feeding device is in the following state:
the first control valve 71 is opened, the second control valve 72 is closed, the third control valve 73 is opened, the fourth control valve 74 is closed, the fifth control valve 75 and the sixth control valve 76 are closed, and the inlet of the fourth reversing valve 94 may communicate with the first outlet or the second outlet, at the moment, the connecting pipeline 4 communicates with the flushing pipeline 6, the inlet water flow in the first water supply pipeline 21 directly flows into the connecting pipeline 4 through the flushing pipeline 6, returns to the first water supply pipeline 21 by the pumping port 12 of the first venturi tube 101 after flushing the connecting pipeline 4, and then flows from the water outlet end of the first water supply pipeline 21 to the corresponding first water tub 51 or second water tub 52, so that the aim that the residual additives in the connecting pipeline 4 and the first venturi tube 101 are flushed is achieved.

When the pumping structure 1 arranged on the second water supply pipeline 22 is flushed, the automatic feeding device is in the following state:
the second control valve 72 is opened, the first control valve 71 is closed, the fourth control valve 74 is opened, the third control valve 73 is closed, the fifth control valve 75 and the sixth control valve 76 are closed, and the inlet of the fifth reversing valve 95 may communicate with the first outlet or the second outlet, at the moment, the connecting pipeline 4 communicates with the flushing pipeline 6, the inlet water flow in the second water supply pipeline 22 directly flows into the connecting pipeline 4 through the flushing pipeline 6, returns to the second water supply pipeline 22 by the pumping port 12 of the second venturi tube 102 after flushing the connecting pipeline 4, and then flows from the water outlet end of the second water supply pipeline 22 to the corresponding first water tub 51 or second water tub 52, so that the aim that the residual additives in the connecting pipeline 4 and the second venturi tube 102 are flushed is achieved.

Embodiment 20

Figure 11:
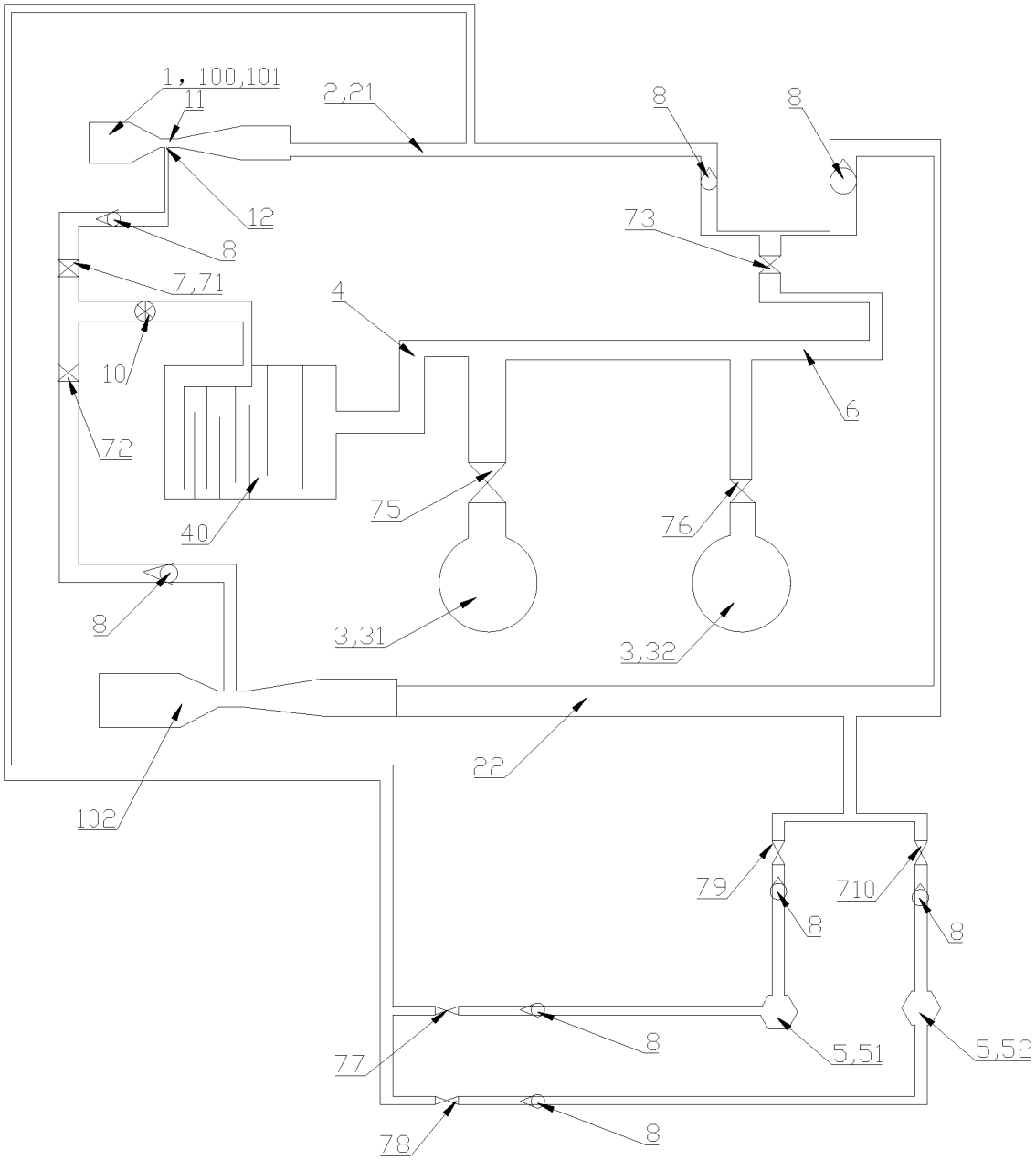

As shown in FIG. 11, different from above-mentioned embodiment 19, the present embodiment lies in that: the port arranged at the water outlet end of each of the water supply pipelines 2 is connected with a water inlet end of a flushing pipeline 6 by a pipeline provided with a one-way valve 8, and the water inlet end of the flushing pipeline 6 is provided with a third control valve 73 for controlling on/off of the pipeline.

Due to such an arrangement, when the additives are fed into the water tubs by the automatic feeding device, the third control valve 73 is closed, inlet water flowing through the first water supply pipeline 21 or the second water supply pipeline 22 is incapable of flowing into the flushing pipeline 6 under the action of the closed third control valve 73 and is incapable of flowing into the other water supply pipeline 2 due to limitations from the one-way valve 8, and the inlet water flow is enabled to totally flow into the corresponding water tubs 5, so that the aim that any one of the water tubs 5 is supplied with water or automatically fed with the additives is achieved.

Meanwhile, when each of the pumping structures 1 is flushed by the automatic feeding device, the third control valve 73 is opened, the inlet water flowing through the first water supply pipeline 21 or the second water supply pipeline 22 is incapable of flowing into the other water supply pipeline 2 due to limitations from the one-way valve 8, a part of the inlet water flow is enabled to flow into the corresponding water tub 5, the other part of the inlet water flow flows into the connecting pipeline 4 through the flushing pipeline 6, flushing water returns to the corresponding water supply pipeline 2 through the corresponding pumping structure 1, and the returned flushing water flows into the corresponding water tub 5 along the corresponding water supply pipeline 2, so that the aim that the corresponding pumping structure 1 is flushed is achieved.

In the present embodiment, the water outlet end of each of the water supply pipelines 2 communicates with each of the water tubs 5 in a one-to-one correspondence way by a different pipeline, and each of the pipelines is provided with a control valve 7 for controlling the on/off of the pipeline so as to ensure that each of the water supply pipelines may communicate with any one of the water tubs.

A multi-drum washing machine provided with two water tubs 5 respectively being a first water tub 51 and a second water tub 52 and two liquid storage parts 3 respectively being a first liquid storage part 31 and a second liquid storage part 32 is taken as an example to be described below, and the specific structure is described as follows:

as shown in FIG. 11, a water outlet end of a first water supply pipeline 21 communicates with the first water tub 51 by a pipeline provided with a seventh control valve 77, the water outlet end of the first water supply pipeline 21 communicates with the second water tub 52 by a pipeline provided with an eighth control valve 78, a water outlet end of a second water supply pipeline 22 communicates with the first water tub 51 by a pipeline provided with a ninth control valve 79, the water outlet end of the second water supply pipeline 22 communicates with the second water tub 52 by a pipeline provided with a tenth control valve 710. Therefore, when each of the water supply pipelines 2 supplies water to the first water tub 51 or the second water tub 52, the corresponding control valve 7 is opened, so that a water flow flows into the corresponding water tub by the corresponding pipeline.

Embodiment 21

Figure 12:
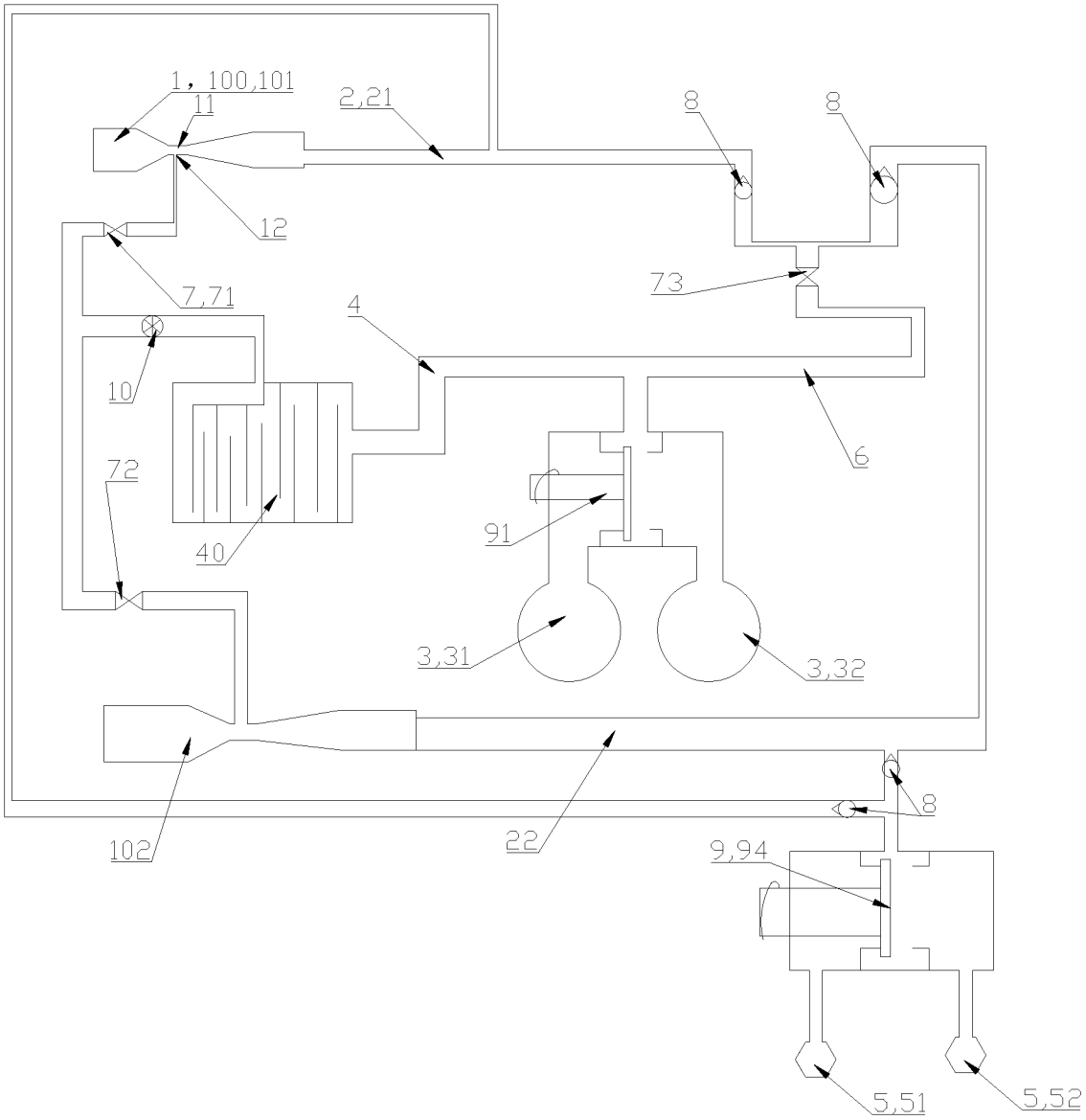

As shown in FIG. 12, different from above-mentioned embodiment 20, the present embodiment lies in that: the connecting line 4 is connected with a reversing valve 9 which is a first reversing valve 91; the first reversing valve 91 is a valve body with one outlet and a plurality of inlets, each of the inlets of the first reversing valve 91 communicates with each of the liquid storage parts 3 in a one-to-one correspondence way, and the outlet of the first reversing valve 91 communicates with the connecting pipeline 4.

Due to such an arrangement, when different additives are fed into the water tubs 5 by the automatic feeding device, a valve element of the first reversing valve 91 is correspondingly regulated to enable the first liquid storage part 31 or the second liquid storage part 32 to communicate with the pumping port 12 of the pumping structure 1 arranged on the corresponding water supply pipeline 2 by a connecting pipeline 4, so that the aim that the different types of additives are respectively fed into the different water tubs 5 is achieved.

Embodiment 22

Different from the above-mentioned embodiment, the present embodiment lies in that: the water outlet end of each of the water supply pipelines 2 communicates with the same connecting pipeline 4 by a different flushing pipeline 6, and each of the flushing pipelines 6 is provided with a control valve 7 for controlling on/off of the pipeline, so that the aim that the automatic feeding device is automatically flushed by virtue of inlet water of the different water supply pipelines 2 is achieved (not shown in the figure).

Embodiment 23

Different from the above-mentioned embodiment, the present embodiment lies in that: the pumping port 12 of the pumping structure 1 arranged on each of the water supply pipelines 2 communicates with a different connecting pipeline 4 in a one-to-one correspondence way, any one of the connecting pipelines 4 communicates with each of the liquid storage parts 3 in a one-to-one correspondence way by a pipeline provided with a control valve 7 or communicates with one of the liquid storage parts 3 by a reversing valve 9, so that the aim that the additives are respectively fed into the corresponding water supply pipelines 2 by different connecting pipelines 4 is achieved (not shown in the figure).

Embodiment 24

Different from the above-mentioned embodiment, the present embodiment lies in that: the pumping port 12 of the pumping structure 1 arranged on each of the water supply pipelines 2 communicates with a different connecting pipeline 4 in a one-to-one correspondence way, any one of the connecting pipelines 4 communicates with each of the liquid storage parts 3 in a one-to-one correspondence way by a pipeline provided with a control valve 7 or communicates with one of the liquid storage parts 3 by a reversing valve 9, so that the aim that the additives are respectively fed into the corresponding water supply pipelines 2 by the different connecting pipelines 4 is achieved (not shown in the figure).

Embodiment 25

The present embodiment introduces a control method of the automatic feeding device applied to any one of above-mentioned embodiments 17-24, when the additives are fed, a water flow at a water supply source flows to the corresponding water tub by one of the water supply pipelines, the additives in the liquid storage parts are pumped out by virtue of a negative pressure generated when the water flow flows through the pumping structure, enter the corresponding water supply pipeline by the pumping port, and are then flushed into the corresponding water tub with the water flow in the water supply pipeline.

In the present embodiment, when the pumping structures are flushed, the water supply pipelines communicate with the flushing pipeline, the liquid storage parts are disconnected with the pumping structures, the water flows in the water supply pipelines flow to the pumping structures through the flushing pipeline, and then return to the water supply pipelines by the pumping ports of the pumping structures; and preferably, when the pumping structures are flushed, the water outlet ends of the water supply pipelines communicate with the flushing pipeline and one of the water outlets, parts of the water flows in the water supply pipelines flow to one of the water outlets, and the other parts of the water flows flow to the flushing pipeline, and after the pumping structures are flushed by the flushing pipeline, flushing water returning from the pumping ports to the flushing pipeline may flow out of one of the water outlets.

In the present embodiment, the different types of additives stored in the plurality of liquid storage parts may be respectively fed by the automatic feeding device. When the additives are fed by the automatic feeding device, one of the pumping ports communicates with each of liquid storage parts, so that the corresponding liquid storage parts communicate with the water supply pipelines, and the additives stored in the corresponding liquid storage parts are pumped into the water supply pipelines and are flushed into the corresponding water tubs with the inlet water flows.

A multi-drum washing machine provided with two water tubs respectively being a first water tub and a second water tub and two liquid storage parts respectively being a first liquid storage part and a second liquid storage part is taken as an example to be described below, and the specific control method is described as follows:

when an additive A stored in the first liquid storage part is fed into the first water tub, the first water supply pipeline or the second water supply pipeline of the automatic feeding device supplies washing water to the first water tub, during water supply, an outlet of the first liquid storage part is interruptedly opened, when the outlet of the first liquid storage part is opened, the additive A stored in the first liquid storage part is pumped into the water supply pipeline by the pumping structure on the water supply pipeline by virtue of the connecting pipeline and is flushed into the first water tub with the inlet water flow; and within the time period when the outlet of the first liquid storage part is closed, a part of the water flow in the water supply pipeline flows into the pumping structure through the flushing pipeline and the connecting pipeline to flush the residual additive A in the pumping structure and the connecting pipeline, so that the additive A which is pumped and fed once is totally flushed into the first water tub with a flushing water flow.

When the additive A stored in the first liquid storage part is fed into the second water tub, the first water supply pipeline or the second water supply pipeline of the automatic feeding device supplies washing water to the second water tub, during water supply, the outlet of the first liquid storage part is interruptedly opened, when the outlet of the first liquid storage part is opened, the additive A stored in the first liquid storage part is pumped into the water supply pipeline by the pumping structure on the water supply pipeline by virtue of the connecting pipeline and is flushed into the second water tub with the inlet water flow; and within the time period when the outlet of the first liquid storage part is closed, a part of the water flow in the water supply pipeline flows into the pumping structure through the flushing pipeline and the connecting pipeline to flush the residual additive A in the pumping structure and the connecting pipeline, so that the additive A which is pumped and fed once is totally flushed into the second water tub with a flushing water flow.

When an additive B stored in the second liquid storage part is fed into the first water tub, the first water supply pipeline or the second water supply pipeline of the automatic feeding device supplies washing water to the first water tub, during water supply, an outlet of the second liquid storage part is interruptedly opened, when the outlet of the second liquid storage part is opened, the additive B stored in the second liquid storage part is pumped into the water supply pipeline by the pumping structure on the water supply pipeline by virtue of the connecting pipeline and is flushed into the first water tub with the inlet water flow; and within the time period when the outlet of the second liquid storage part is closed, a part of the water flow in the water supply pipeline flows into the pumping structure through the flushing pipeline and the connecting pipeline to flush the residual additive B in the pumping structure and the connecting pipeline, so that the additive B which is pumped and fed once is totally flushed into the first water tub with a flushing water flow.

When the additive B stored in the second liquid storage part is fed into the second water tub, the first water supply pipeline or the second water supply pipeline of the automatic feeding device supplies washing water to the second water tub, during water supply, the outlet of the second liquid storage part is interruptedly opened, when the outlet of the second liquid storage part is opened, the additive B stored in the second liquid storage part is pumped into the water supply pipeline by the pumping structure on the water supply pipeline by virtue of the connecting pipeline and is flushed into the second water tub with the inlet water flow; and within the time period when the outlet of the second liquid storage part is closed, a part of the water flow in the water supply pipeline flows into the pumping structure through the flushing pipeline and the connecting pipeline to flush the residual additive B in the pumping structure and the connecting pipeline, so that the additive B which is pumped and fed once is totally flushed into the second water tub with a flushing water flow.

The above description should not be constructed as limitations on the present disclosure in any form, but merely as preferred embodiments of the present disclosure. The present disclosure has been disclosed as above with the preferred embodiments, but the preferred embodiments are not intended to limit the present disclosure. Any one of those skilled in the patent can vary or modify embodiments into equivalent embodiments with the same variation by virtue of the technical content prompted as above without departing from the scope of the technical solutions of the present disclosure, however, any simple alterations as well as equivalent variations and modifications made on the above-mentioned embodiments according to the technical essence of the present disclosure without departing from the contents of the technical solutions of the present disclosure shall fall within the scope of the solutions of the present disclosure.

The invention claimed is:

1. An automatic feeding device, comprising:

at least two water outlets;

a water supply pipeline configured to controllably and reversibly deliver inlet water to any one of the water outlets;

at least two liquid storage parts each configured to contain additive; and a pumping structure configured to generate a negative pressure by virtue of a water flow flowing through the water supply pipeline to pump out the additives in the at least two liquid storage parts and deliver the additives to the selected water outlet with the water flow;

the at least two liquid storage parts include a first liquid storage part and a second liquid storage part;

a flushing pipeline, wherein at least a part of the water flow at a water outlet end of the water supply pipeline is directly introduced to the pumping structure by the flushing pipeline to perform flushing, and then returns to the water supply pipeline through the pumping structure;

two ends of a connecting pipeline respectively communicate with a water outlet end of the flushing pipeline and a pumping port of the pumping structure;

the connecting pipeline is connected in series with first and second reversing valves, and a reversing port of each of the reversing valves communicates with each of the liquid storage parts in a one-to-one correspondence; and configured so that when any one of the reversing valves is switched to enable the corresponding liquid storage part to communicate with the pumping port of the pumping structure, the two reversing ports, communicating with the connecting pipeline, of the reversing valve are disconnected;

each of the first reversing valve and the second reversing valve is a valve body provided with two inlets and one outlet, and the inlets are configured to respectively communicate with the two outlets under the actions of valve elements inside the valve bodies;

a first inlet and the outlet of each of the first reversing valve and the second reversing valve are both formed in the connecting pipeline, and second inlets of the first reversing valve and the second reversing valve respectively communicate with the first liquid storage part and the second liquid storage part in a one-to-one correspondence.

2. The automatic feeding device according to claim 1, wherein the flushing pipeline is provided with a one-way valve for ensuring that a water flow in the flushing pipeline flows from a water inlet end to the water outlet end in a single direction; and the flushing pipeline is provided with a control valve for controlling the water flow to flow in the flushing pipeline or not.

3. The automatic feeding device according to claim 2, wherein the connecting pipeline is provided with a metering device for detecting a flow of a liquid flowing through the pipeline; and the connecting pipeline is provided with a one-way valve for ensuring that the liquid in the pipeline flows to one end of the pumping port of the pumping structure in a single direction.

4. The automatic feeding device according to claim 1, wherein the water outlet end of the water supply pipeline communicates with a first water outlet or a second water outlet by a third reversing valve;

or, the water outlet end of the water supply pipeline is respectively connected with the first water outlet and the second water outlet by two different pipelines, and each of the two pipelines is provided with a control valve for controlling the on/off of the pipeline; and the water supply pipeline is provided with a one-way valve for ensuring the water flow in the pipeline flows from a water inlet source end to the water outlet end in a single direction.

5. The automatic feeding device according to claim 1, wherein the pumping structure comprises a venturi tube arranged in the water supply pipeline and configured to generate the negative pressure by virtue of the flowing of the water flow, and a negative pressure region of the venturi tube is provided with the pumping port communicating with the liquid storage parts and used for pumping the additives into the water flow of the water supply pipeline by virtue of the negative pressure; and two ends of the venturi tube are both connected into the water supply pipeline and respectively and correspondingly communicate with the water inlet end and the water outlet end; and the middle of the venturi tube is provided with a necking part of which the inner wall tube diameter is suddenly reduced, the flow rate of the water flow flowing through the necking part is suddenly increased to generate the negative pressure to form the negative pressure region.

6. The automatic feeding device according to claim 3, wherein the connecting pipeline including a pipeline located between each of the liquid storage parts and the pumping structure and is provided with a labyrinth loop;

each of the connecting pipelines communicates with the pumping port of the pumping structure by the same labyrinth loop;

the metering device for detecting the flow of the flowing liquid is arranged between the labyrinth loop and the pumping port of the pumping structure; and the labyrinth loop communicates with the pumping port of the pumping structure by a pipeline provided with a control valve, and the control valve controls the on/off of the pipeline.

7. The automatic feeding device according to claim 1, comprising:

at least two water supply pipelines, capable of respectively delivering inlet water to water outlets of the corresponding water supply pipelines, wherein each of the water supply pipelines is provided with a pumping structure capable of generating a negative pressure by virtue of a water flow flowing through the corresponding water supply pipeline to pump out the additives in the liquid storage parts and deliver the additives to the water outlet of the corresponding water supply pipeline with the water flow.

8. The automatic feeding device according to claim 7, wherein the water outlet end of each of the water supply pipelines is connected with each of the pumping structures in a one-to-one correspondence way by a different flushing pipeline;

or, the water outlet end of any one of the water supply pipelines communicates with the water inlet end of one of the flushing pipelines, and the water outlet end of the flushing pipeline communicates with one of the pumping structures by a reversing valve;

or, the water outlet end of any one of the water supply pipelines communicates with the water inlet end of one of the flushing pipelines, and the water outlet end of the flushing pipeline is connected with each of the pumping structures in a one-to-one correspondence way by a pipeline provided with a control valve;

or, the water outlet end of each of the water supply pipelines is correspondingly connected, by one of the flushing pipelines, with the pumping structure arranged on the water supply pipeline.

9. The automatic feeding device according to claim 7, comprising at least two liquid storage parts, wherein each of the liquid storage parts is connected with a pumping port of each of the pumping structures in a one-to-one correspondence way by a different connecting pipeline, and each of the connecting pipelines is provided with a control valve for controlling the on/off of the pipeline;

or, one of the at least two liquid storage parts communicates with the same connecting pipeline by a reversing valve;

or, the at least two liquid storage parts respectively communicate with the same connecting pipeline by pipelines provided with control valves;

the water outlet end of the connecting pipeline communicates with the pumping port of one of the at least two pumping structures by a reversing valve;

or, the water outlet end of the connecting pipeline respectively communicates with the pumping ports of the at least two pumping structures by pipelines provided with control valves;

each of the connecting pipelines communicates with each of the water supply pipelines by a different flushing pipeline in one-to-one correspondence to each of the connecting pipelines;

or, each of the connecting pipelines is connected with the same flushing pipeline by a reversing structure, and the flushing pipeline is enabled to communicate with one of the connecting pipelines under the action of the reversing structure;

or, each of the water supply pipelines is connected with one of the corresponding flushing pipelines, each of the flushing pipelines is connected with one of the connecting pipelines by a reversing valve, and one of the flushing pipelines is enabled to communicate with the connecting pipeline under the action of the reversing structure;

the connecting pipeline is provided with a metering device for detecting a flow of a liquid flowing through the pipeline; and the connecting pipeline is provided with a one-way valve for ensuring that the liquid in the pipeline flows to one end of the pumping port of each of the pumping structures in a single direction.

10. The automatic feeding device according to claim 7, wherein the water outlet end of each of the water supply pipelines communicates with the different water outlets in one-to-one correspondence to the water outlet ends; and the water supply pipelines are provided with one-way valves for ensuring the water flows in the pipelines flow from water inlet source ends to the water outlet ends in a single direction.

11. The automatic feeding device according to claim 7, wherein each of the pumping structures comprises a venturi tube arranged in each of the water supply pipelines and capable of generating a negative pressure by virtue of the flowing of the water flow, and a negative pressure region is provided with a pumping port communicating with each of the liquid storage parts and used for pumping the additives into the water flow of the water supply pipeline by virtue of the negative pressure; and two ends of the venturi tube are both connected into the corresponding water supply pipeline and respectively and correspondingly communicate with the water inlet end and the water outlet end; and the middle of the venturi tube is provided with a necking part of which the inner wall tube diameter is suddenly reduced, a negative pressure is generated at the necking part with the sudden increase of the flow rate of the water flow to form a negative pressure region, the negative pressure region is provided with a port communicating with the outside, and the port forms the pumping port, communicating with the liquid storage parts by the connecting pipelines, of the pumping structure.

12. The automatic feeding device according to claim 7, wherein the connecting pipeline located between each of the liquid storage parts and each of the pumping structures is provided with a labyrinth loop arranged to be swirled and capable of extending the axial length of the pipeline;

each of the connecting pipelines communicates with the pumping ports of the pumping structures by the same labyrinth loop;

the metering device for detecting the flow of the flowing liquid is arranged between the labyrinth loop and the pumping port of each of the pumping structures; and the labyrinth loop communicates with the pumping ports of the pumping structures by pipelines provided with control valves, and the control valves control the on/off of the pipelines.

13. The automatic feeding device according to claim 1, comprising:

at least two water supply pipelines, capable of controllably and reversibly delivering inlet water to any one of the water outlets, wherein each of the water supply pipelines is provided with a pumping structure capable of generating a negative pressure by virtue of a water flow flowing through the corresponding water supply pipeline to pump out the additives in the liquid storage parts and deliver the additives to the selected water outlet of the corresponding water supply pipeline with the water flow.

14. The automatic feeding device according to claim 13, wherein the water outlet end of each of the water supply pipelines is connected with each of the pumping structures in a one-to-one correspondence way by a different flushing pipeline;

or, the water outlet end of any one of the water supply pipelines communicates with the water inlet end of one of the flushing pipelines, and the water outlet end of the flushing pipeline communicates with one of the pumping structures by a reversing valve;

or, the water outlet end of any one of the water supply pipelines communicates with the water inlet end of one of the flushing pipelines, and the water outlet end of the flushing pipeline is connected with each of the pumping structures in a one-to-one correspondence way by a pipeline provided with a control valve;

or, the water outlet end of each of the water supply pipelines is correspondingly connected, by one of the flushing pipelines, with the pumping structure arranged on the water supply pipeline.

15. The automatic feeding device according to claim 13, comprising at least two liquid storage parts, wherein each of the liquid storage parts is connected with a pumping port of each of the pumping structures in a one-to-one correspondence way by a different connecting pipeline, and each of the connecting pipelines is provided with a control valve for controlling the on/off of the pipeline;

or, one of the at least two liquid storage parts communicates with the same connecting pipeline by a reversing valve;

or, the at least two liquid storage parts respectively communicate with the same connecting pipeline by pipelines provided with control valves;

the water outlet end of the connecting pipeline communicates with the pumping port of one of the at least two pumping structures by a reversing valve;

or, the water outlet end of the connecting pipeline respectively communicates with the pumping ports of the at least two pumping structures by pipelines provided with control valves.

16. The automatic feeding device according to claim 15, wherein each of the connecting pipelines communicates with each of the water supply pipelines by a different flushing pipeline in one-to-one correspondence to each of the connecting pipelines;

or, each of the connecting pipelines is connected with the same flushing pipeline by a reversing structure, and the flushing pipeline is enabled to communicate with one of the connecting pipelines under the action of the reversing structure;

or, each of the water supply pipelines is connected with one of the corresponding flushing pipelines, one of the flushing pipelines is connected with one of the connecting pipelines by a reversing valve, and one of the flushing pipelines is enabled to communicate with the connecting pipeline under the action of the reversing structure;

the connecting pipeline is provided with a metering device for detecting a flow of a liquid flowing through the pipeline; and the connecting pipeline is provided with a one-way valve for ensuring that the liquid in the pipeline flows to one end of the pumping port of each of the pumping structures in a single direction.

17. The automatic feeding device according to claim 13, wherein the water outlet end of each of the water supply pipelines is connected with each of the water outlets by a reversing structure, and one of the water supply pipelines is enabled to communicate with each of the water outlets under the action of the reversing structure;

or, the water outlet end of each of the water supply pipelines is connected with each of the water outlets in a one-to-one correspondence way by a different pipeline; and each of the pipelines is provided with a control valve for controlling the on/off of the pipeline;

the water supply pipelines are provided with one-way valves for ensuring the water flows in the pipelines flow from water inlet source ends to the water outlet ends in a single direction.

18. The automatic feeding device according to claim 13, wherein each of the pumping structures comprises a venturi tube arranged in each of the water supply pipelines and capable of generating a negative pressure by virtue of the flowing of the water flow, and a negative pressure region is provided with a pumping port communicating with each of the liquid storage parts and used for pumping the additives into the water flow of the water supply pipeline by virtue of the negative pressure; and two ends of the venturi tube are both connected into the corresponding water supply pipeline and respectively and correspondingly communicate with the water inlet end and the water outlet end; and the middle of the venturi tube is provided with a necking part of which the inner wall tube diameter is suddenly reduced, a negative pressure is generated at the necking part with the sudden increase of the flow rate of the water flow to form a negative pressure region, the negative pressure region is provided with a port communicating with the outside, and the port forms the pumping port, communicating with each of the liquid storage parts by the connecting pipelines, of the pumping structure.

19. The automatic feeding device according to claim 13, wherein the connecting pipeline located between each of the liquid storage parts and each of the pumping structures is provided with a labyrinth loop arranged to be swirled and capable of extending the axial length of the pipeline;

each of the connecting pipelines communicates with the pumping ports of the pumping structures by the same labyrinth loop;

the metering device for detecting the flow of the flowing liquid is arranged between the labyrinth loop and the pumping port of each of the pumping structures; and the labyrinth loop communicates with the pumping ports of the pumping structures by pipelines provided with control valves, and the control valves control the on/off of the pipelines.

20. A multi-drum washing machine, comprising at least two water tubs, wherein the multi-drum washing machine is provided with the automatic feeding device according to claim 1, each of the water tubs communicates with each of the water outlets, in one-to-one correspondence to the water tubs, of the automatic feeding device, so that the additives pumped out of the liquid storage parts by the pumping structures are controllably delivered to any one of the water tubs;

the water inlet end of each of the water supply pipelines of the automatic feeding device communicates with a water inlet structure of the washing machine, and washing water supplied by the water inlet structure of the washing machine is used as the water supply source at the water inlet end of each of the water supply pipelines; and the washing water flows into one of the water supply pipelines and controllably and reversibly flows from the water outlet end of the water supply pipeline to the corresponding water tub by any one of the water outlets, so that the additives pumped into the corresponding water supply pipeline flow into the corresponding water tub with an inlet water flow of the washing machine.

* * * * *